US006916076B2

(12) United States Patent
Yoshiyama et al.

(10) Patent No.: US 6,916,076 B2
(45) Date of Patent: Jul. 12, 2005

(54) IMAGE FORMING DEVICE CAPABLE OF DETECTING EXISTENCE OF INK AND INK CARTRIDGE WITH HIGH ACCURACY

(75) Inventors: Masatoshi Yoshiyama, Nagoya (JP); Atsushi Murakami, Nagoya (JP); Tetsuya Ouchi, Nagoya (JP); Kazuhiro Hayamizu, Nishikamo-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 58 days.

(21) Appl. No.: 10/424,756

(22) Filed: Apr. 29, 2003

(65) Prior Publication Data

US 2003/0210289 A1 Nov. 13, 2003

Related U.S. Application Data

(62) Division of application No. 10/108,868, filed on Mar. 29, 2002, now Pat. No. 6,619,776.

(30) Foreign Application Priority Data

| | | |
|---|---|---|
| Mar. 30, 2001 | (JP) | 2001-102695 |
| Aug. 28, 2001 | (JP) | 2001-258553 |
| Aug. 29, 2001 | (JP) | 2001-259835 |
| Aug. 29, 2001 | (JP) | 2001-259836 |

(51) Int. Cl.[7] ..... B41J 2/195
(52) U.S. Cl. ..... 347/7
(58) Field of Search ..... 347/7, 19, 85, 347/12, 5, 10, 9, 23, 14, 86, 87, 11

(56) References Cited

U.S. PATENT DOCUMENTS

| | | | | |
|---|---|---|---|---|
| 6,137,503 | A | 10/2000 | Hashimoto et al. | |
| 6,454,400 | B1 | 9/2002 | Morita et al. | |
| 6,619,776 | B2 * | 9/2003 | Yoshiyama et al. | 347/7 |

FOREIGN PATENT DOCUMENTS

| | | |
|---|---|---|
| JP | A 9-240010 | 9/1997 |
| JP | A 11-277760 | 10/1999 |

* cited by examiner

*Primary Examiner*—Stephen Meier
*Assistant Examiner*—Charles Stewart, Jr.
(74) *Attorney, Agent, or Firm*—Oliff & Berridge, PLC

(57) ABSTRACT

In a calibration data input process, a carriage 5 is moved toward an ink sensor 19 to a prescribed position while the ink sensor 19 detecting levels of reflected light. Then the amount of reflected light is read for over a range wider than the width of the carriage 5 including a theoretical detecting position P2. An actual detecting position P1 is found based on the level of reflected light. The difference between the theoretical detecting position P2 and the actual detecting position P1 is calculated and is stored as the calibration value α in a first calibration data memory M1. Accordingly, the actual detecting position P1 is set as P2±α. The calibration value α is used in a calibration process to calibrate the detecting position, so that the level of reflected light can be detected with accuracy.

16 Claims, 24 Drawing Sheets

FIG.5(a)
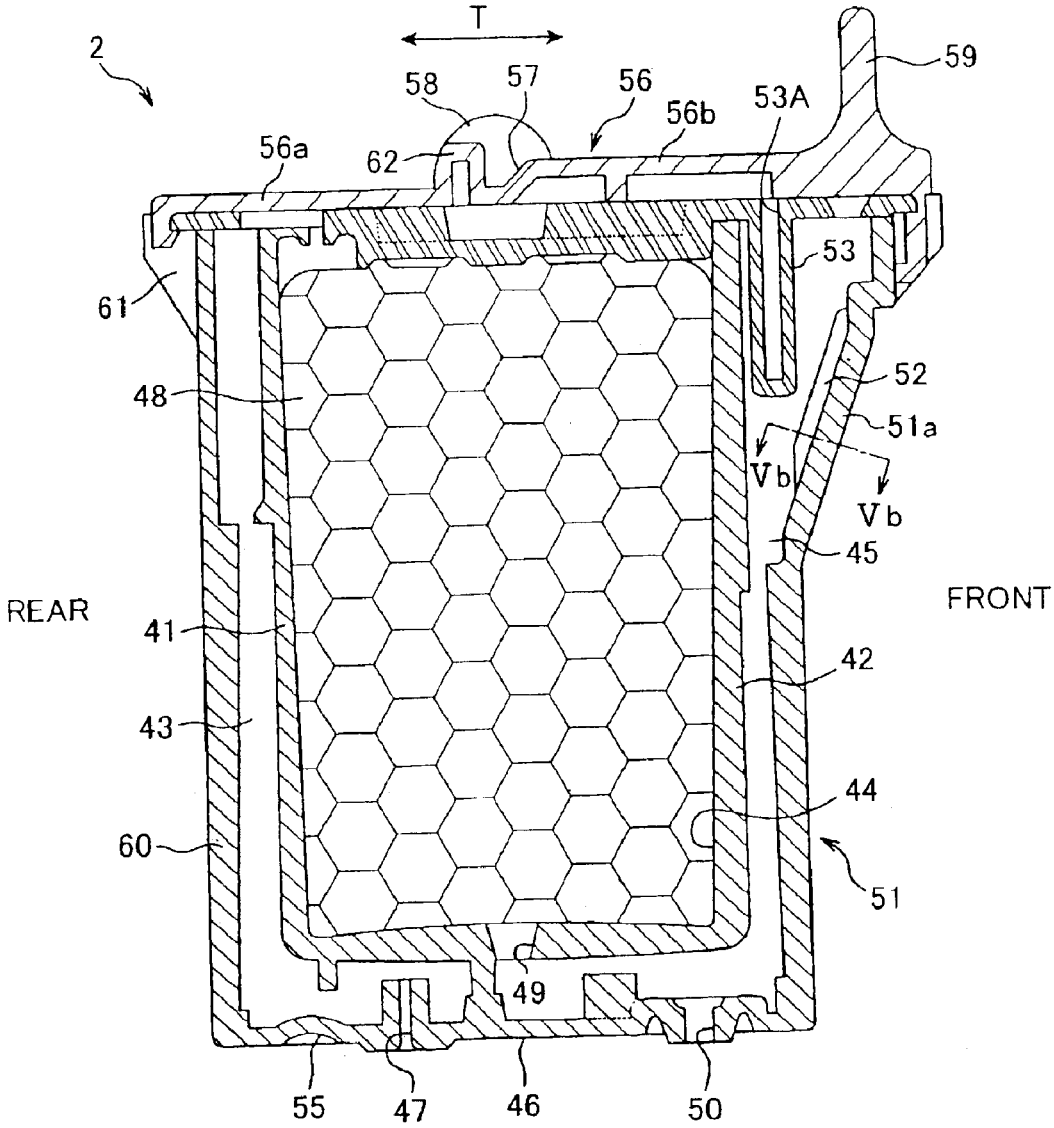
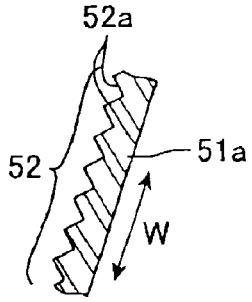
FIG.5(b)
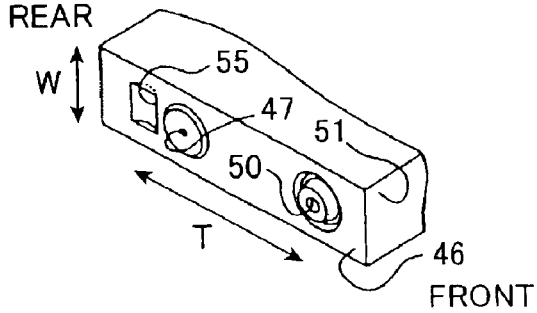
FIG.5(c)

IMAGE FORMING DEVICE CAPABLE OF DETECTING EXISTENCE OF INK AND INK CARTRIDGE WITH HIGH ACCURACY

This is a Division of application Ser. No. 10/108,868 filed Mar. 29, 2002 now U.S. Pat. No. 6,619,776. The entire disclosure of the prior application is hereby incorporated by reference herein in its entirety.

BACKGROUND OF THE INVENTION

1. Field of the Invention

The present invention relates to an image-forming device, such as an inkjet printer, having an optical sensor for detecting ink cartridges mounted in the device, as well as the existence of ink in the ink cartridges.

2. Description of the Related Art

Conventional inkjet printers used as image-forming devices, such as facsimile devices, photocopying devices, and the like, are provided with an optical sensor for optically detecting whether an ink cartridge is mounted in the device and whether the cartridge contains ink. This optical sensor includes a light-emitting element for radiating a light toward an ink cartridge, which is formed of an optically transparent material, and a light-receiving element for sensing the amount of light reflected by or permeated through the ink cartridge. Since the amount of light reaching the light-receiving element changes according to the existence of ink and the existence of an ink cartridge, the optical sensor can sense the existence of ink or an ink cartridge by detecting the amount of received light.

Sometimes a light different from expected one is reflected from the irradiated surface of the ink cartridge or the like, due to the condition of the irradiated surface. Such a light consists a noise signal, thereby degrading the detecting precision. For this reason, the inventors of the present invention attempted to reduce the noise signal by orienting the optical sensor to radiate light onto the surface of the ink cartridge in a non-perpendicular direction, specifically at an inclination angle of about 10 degrees.

However, it is difficult to slant the optical sensor at the prescribed angle in relation to the irradiation surface of the ink cartridge. If there is an error in the mounting angle of the optical sensor, the relative positioning of the optical sensor and the irradiation surface of the ink cartridge will be different from the intended setting. As a result, the optical sensor cannot detect the light or a portion of the light that is reflected from the ink cartridge at the intended detecting position and cannot, therefore, accurately detect the existence of ink or of a mounted ink cartridge.

Further, due to irregularities in its sensitivity, the optical sensor may not achieve precise detection when the intensity of irradiated light from the light-emitting element is uniform. In order to overcome such a problems, a process has been conventionally conducted to calibrate the intensity of the light irradiated from the light-emitting element. In this process, an ink cartridge is filled with sufficient ink, and the intensity of the light is calibrated so as to achieve a predetermined amount of light received by the optical sensor. This calibrating process is conducted for each printer by controlling the drive of the light-emitting element through pulse-width modulation.

However, because the amount of light reflected from the ink cartridge differs according to the color of ink stored in the cartridge, the calibration process must be conducted for each ink cartridge in a printer provided with a plurality of ink cartridges containing different color ink. This leads to an increase in complexity and duration of the calibration process.

Another conceivable method for overcoming the above problem due to irregularities in sensitivity of the optical sensor is to measure an amount of light reflected from a single ink cartridge and to estimate the amount of reflected light for other ink cartridges based on the measured value. However, it is difficult to estimate appropriate calibration values for other ink cartridges using this method, because the amount of light reflected from the ink cartridge varies according to the color of ink contained therein. Hence, while it is possible to detect with high accuracy the amount of ink remaining in the ink cartridge for which reflected light has been actually measured, it is not possible to measure with accuracy the amount of ink remaining in ink cartridges using the estimated value.

Further, in order to detect the existence of ink optically, it is necessary to move the ink cartridge to a position near the optical sensor, and it requires a certain time interval to move the ink cartridge to such a position and to perform the detection using the optical sensor with respect to the ink cartridge at the position. Because recording operation cannot be performed during this time interval, detecting the existence of ink during the recording operation reduces the processing speed of the recording device.

There has been developed an ink cartridge for practical use that is provided with a plurality of prisms on the irradiated surface of light irradiation. These prisms are integrally formed on the surface of the ink cartridge in a shape that repeatedly alternates in peaks and valleys, which form a plurality of reflecting surfaces. This configuration enables to detect with accuracy the amount of ink remaining in the ink cartridge using the properties of the prisms of reflecting and penetrating light.

However, since this conventional device is configured with only a single optical sensor to detect the existence of ink in a plurality of ink cartridges, the carriage supporting the ink cartridges must be continually moved while the optical sensor is irradiating a light onto each ink cartridge to detect the existence of ink therein. Since the amount of reflected light varies depending on whether it is reflected from a valley or a peak in the prisms or therebetween, the waveform read by the optical sensor has a zigzag shape. Accordingly, it is not always possible to detect the existence of ink with accuracy at some reading points.

In view of the foregoing, it is an object of the present invention to provide an image-forming device capable of detecting with accuracy the existence of ink cartridges mounted in the device and the existence of ink contained in the ink cartridges using optical sensors.

It is another object of the present invention to provide an image-forming device having a simple construction and capable of reliably calibrating the intensity of light irradiated from the optical ink sensor to detect with accuracy the existence of ink and ink cartridge.

It is another object of the present invention to provide an image-forming device capable of detecting the existence of ink without slowing the processing speed of the image-forming device.

It is another object of the present invention to provide an image-forming device employing prisms to form alternate peaks and valleys on the ink cartridge and capable of accurately detecting the existence of ink cartridges and of ink inside the ink cartridges while the ink cartridges are moving.

In order to achieve the above and other objects, according to the present invention, there is provided an image forming device including a cartridge, a carriage, a sensor, a memory, and a first detection unit. The cartridge contains an ink and has a surface. The carriage mounts the cartridge thereon and reciprocally moves along with the cartridge. The sensor detects an amount of a reflected light reflected from the cartridge. The sensor includes a light emitting unit and a light receiving unit. The light emitting unit irradiates a light onto the surface of the cartridge in a non-perpendicular direction with respect to the surface while the carriage is moving along with the cartridge. The light receiving unit receives the reflected light. The amount of the reflected light changes depending on the amount of ink contained in the cartridge and further on existence and non-existence of the cartridge on the carriage. The memory stores a first threshold value and a second threshold value differing from the first threshold value. The first detecting unit compares the amount of received light and the first threshold value for detecting an ink-near empty condition of the cartridge and compares the amount of received light and the second threshold value for detecting whether or not the cartridge is mounted on the carriage.

There is also provided an image forming device including at least one cartridge, a sensor, a carriage, a control unit, and a detecting unit. The at least one cartridge contains an ink and has an irradiated portion. The sensor that detects an amount of reflected light reflected from the irradiated portion of the cartridge. The sensor includes a light emitting unit that irradiates a light onto the cartridge at the irradiated portion and a light receiving unit that receives the reflected light. The carriage mounts the cartridge thereon and reciprocally moves along with the cartridge. The control unit controls an intensity of the light irradiated from the light emitting unit. The detecting unit moves the carriage to a predetermined position where the light irradiated from the light emitting unit is irradiated on the cartridge at the irradiated portion and detects an amount of the ink contained in the cartridge based on the amount of reflected light detected by the sensor. The detecting unit detects existence of the ink in the cartridge when a level of the ink containing in the cartridge is above the irradiated portion. The control unit controls the intensity of the light such that the detecting unit detects the existence of the ink when the level of the ink is above the irradiated portion of the cartridge based on the amount of reflected light reflected from the irradiated portion of the cartridge that contains a brightest-color ink. With this configuration, accurate detection of the existence of the ink cartridge and the ink in the ink cartridge is achieved.

By using the brightest ink cartridge to adjust the amount of light emitted from the light-emitting element, accurate detection can be achieved even when the sensitivity of the ink sensor is irregular. Further, by performing such adjustments using the ink cartridge with the brightest ink, suitable detection can be reliably performed on ink cartridges containing other inks that are less bright. Therefore, a single adjustment value can be applied to all ink cartridges when multiple colors of ink are used, thereby simplifying the process and reducing the processing time.

Further, there is provided an image forming device including a cartridge, a sensor, a transport means, and a detecting unit. The cartridge contains an ink. The carriage mounts the cartridge thereon and reciprocally moves along with the cartridge. The sensor detects an amount of reflected light reflected from the cartridge. The sensor includes a light emitting unit that irradiates a light onto the cartridge and a light receiving unit that receives the reflected light. The transport means transports a recording medium in relation to a printing operation. The detecting unit controls, during a recording-medium transporting period, the carriage to move to a position where the light irradiated from the light emitting unit is irradiated onto the cartridge and detects an amount of the ink contained in the cartridge based on the amount of reflected light detected by the sensor.

With this configuration, because the detecting unit detects the amount of the ink contained in the cartridge during the paper-feed interval, there is no need to put printing operations on standby, thereby improving processing speed of the image forming device.

There is also provided an image forming device including a cartridge, a carriage, a sensor, a detection unit, and a reading unit. The cartridge contains an ink and has an irradiated portion. The carriage mounts the cartridge thereon and moves along with the cartridge. The sensor detects an amount of reflected light reflected from the irradiated portion of the cartridge. The sensor includes a light emitting unit that irradiates a light onto the cartridge at the irradiated portion and a light receiving unit that receives the reflected light. The detection unit detects an amount of the ink contained in the cartridge based on the amount of the reflected light detected by the sensor. The irradiated portion of the cartridge is provided with prisms in a shape that repeatedly alternates in peaks and valleys. Adjacent two of the valleys are separated by a predetermined first interval. The reading unit controls the carriage to move to a predetermined position where the light irradiated from the light emitting unit is irradiated onto the cartridge and reads levels of reflected light from a waveform for the amount of reflected light at a second interval non-integral multiples of the first interval, based on which the reading unit detecting an amount of the ink contained in the cartridge.

In this configuration, because the second interval is non-integral multiples of the first interval, the reading unit can read the waveform at portions corresponding to portions of the prism other than the valleys. Accordingly, the existence of the ink and of the ink cartridge can be detected with accuracy.

There is also provided an image forming device including a cartridge, a carriage, a sensor, a first memory, a detecting unit, a measuring unit, an error, a second memory, and a calibrating unit. The cartridge contains an ink and has a surface. The carriage mounts the cartridge thereon and reciprocally moves along with the cartridge. The sensor detects an amount of a reflected light reflected from the cartridge. The sensor includes a light emitting unit and a light receiving unit. The light emitting unit irradiates a light onto the surface of the cartridge in a non-perpendicular direction with respect to the surface while the carriage is moving along with the cartridge. The light receiving unit receives the reflected light. The amount of the reflected light changes depending on the amount of ink contained in the cartridge. The first memory stores a threshold value. The detecting unit compares the amount of received light and the threshold value for detecting an ink-near empty condition of the cartridge. The measuring unit measures a detect position of the cartridge based on the amount of reflected light detected by the sensor. The error detection unit detects an error amount between the detect position and a predetermined theoretical position. The second memory stores the error amount. The calibrating unit calibrates a detection position for detecting the ink-near empty condition.

BRIEF DESCRIPTION OF THE DRAWINGS

In the drawings:

FIG. 5(*a*) is a cross-sectional side view of the ink cartridge of FIG. 4;

FIG. 5(*b*) is a cross-sectional view of prisms of the ink cartridge taken along a line Vb—Vb of FIG. 5(*a*);

FIG. 5(*c*) is a perspective view showing the bottom of the ink cartridge of FIG. 4;

FIG. 6(*b*) is the same view as that in FIG. 6(*a*) showing optical paths when the sub ink reservoir in the ink cartridge does not contain sufficient ink;

FIG. 7(*b*) shows optical paths when the ink sensor is slanted an angle larger than 10 degrees from the ink cartridge with respect to the horizontal direction;

FIG. 7(*c*) shows the ink sensor is slanted approximately 10 degrees to the ink cartridge with respect to the horizontal direction;

FIG. 8(*b*) shows a reading waveform corresponding to the peaks and valleys of the prisms of FIG. 8(*a*) and reading positions of the reading waveform;

FIG. 18(*b*) is a graph showing levels of reflected light detected during the calibration data input process;

FIG. 22(*b*) is a side view showing the ink cartridge and the ink sensor of FIG. 22(*a*) and optical paths when the sub ink reservoir in the ink cartridge does not contain ink;

FIG. 23(*b*) is a side view showing the ink cartridge and the ink sensor of FIG. 23(*a*) and the optical paths when the sub ink reservoir in the ink cartridge does not contain ink.

PREFERRED EMBODIMENTS OF THE PRESENT INVENTION

An image-forming device according to preferred embodiments of the present invention will be described while referring to the accompanying drawings. The image-forming device of the present embodiment is a color inkjet printer capable of printing color images. The printer is provided with four ink cartridges 2 storing ink of the colors black, cyan, magenta, and yellow.

Figure 1:
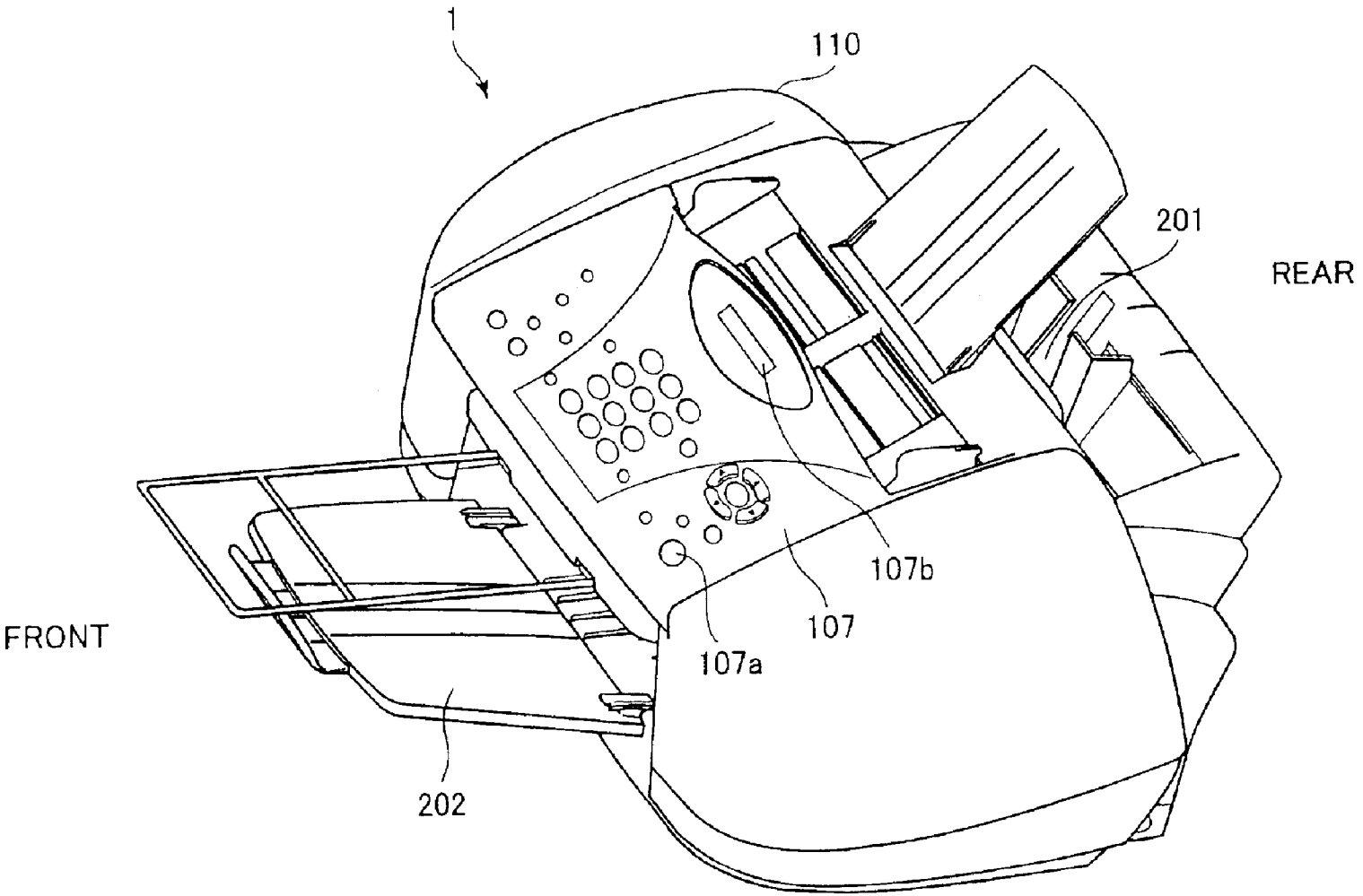
FIG. 1 is a perspective view showing a color inkjet printer according to a first embodiment of the present invention.
Figure 2:
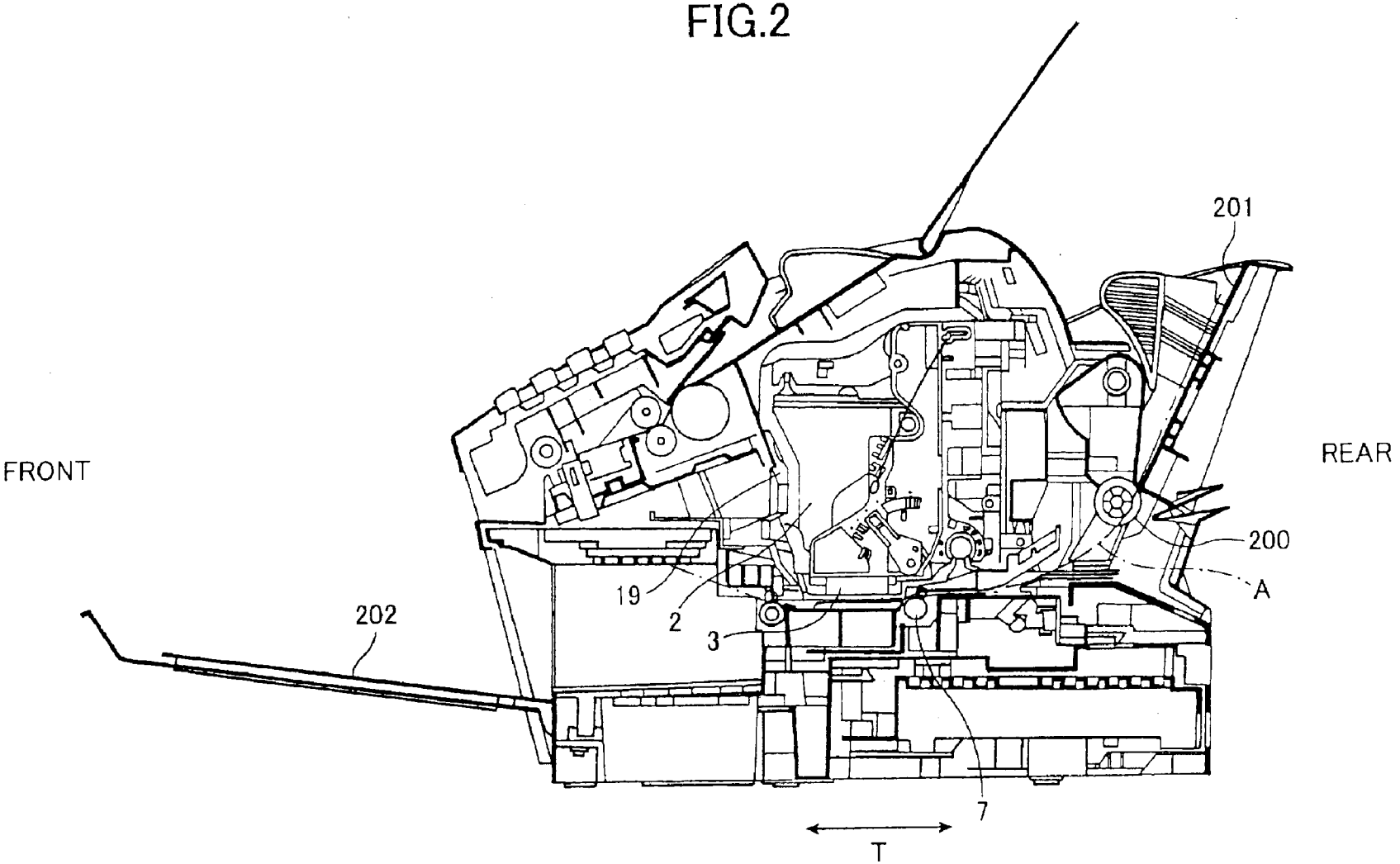
FIG. 2 is a cross-sectional view of the color inkjet printer of FIG. 1.

FIG. 1 is a perspective view of a color inkjet printer 1 according to a first embodiment of the present invention. The inkjet printer 1 is provided with an operating panel 107 on the top surface of a printer case 110. The operating panel 107 includes a mode switch 107*a* and a liquid crystal display 107*b*. The inkjet printer 1 is also provided with a paper feed tray 201 on the back of the printer case 110 and a discharge tray 202 on the front of the printer case 110. FIG. 2 is a cross-sectional view of the inkjet printer 1. As shown in FIG. 2, the inkjet printer 1 is provided internally with the ink cartridges 2, a print head 3, a platen roller 7, an optical ink sensor 19, and a conveying roller 200 for conveying a recording sheet. Detailed descriptions for these components will be provided later.

Recording sheets P are loaded into the paper feed tray 201 and fed one at a time by the conveying roller 200. The recording sheet P is conveyed along a sheet feed direction indicated by an arrow A and introduced between the print head 3 and the platen roller 7. The print head 3 performs a prescribed printing operation on the recording sheet P, and the recording sheet P is subsequently discharged onto the discharge tray 202.

Figure 3:
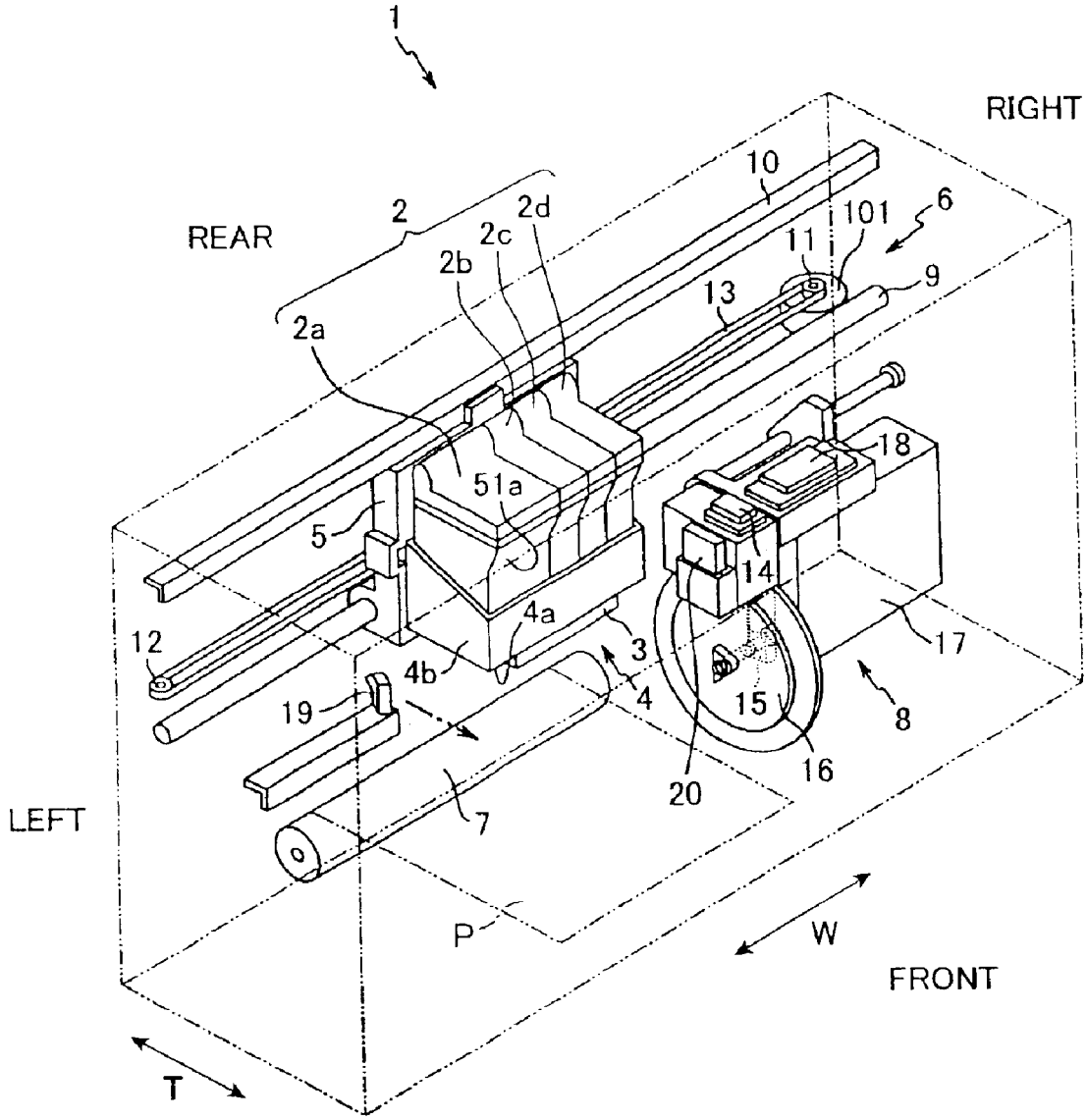
FIG. 3 is a perspective view showing the general configuration of the color inkjet printer of FIG. 1.

FIG. 3 is a perspective view showing the general configuration of the inkjet printer 1. The inkjet printer 1 is further provided with a head unit 4, a carriage 5, a drive unit 6, and a purging unit 8. The head unit 4 is mounted on the carriage 5 and includes the print head 3. The drive unit 6 moves the carriage 5 along with the head unit 4 reciprocally in a straight line along a widthwise direction W. The platen roller 7 is disposed in opposition to the print head 3 and extends in the widthwise direction W. The purging unit 8 performs well known purging operations.

The head unit 4 includes a mounting unit 4*a* formed with substantially flat surface and a pair of side covers 4*b* formed on both sides of the mounting unit 4*a*. A space defined by the mounting unit 4*a* and the side covers 4*b* is partitioned into four spaces by three partitioning walls 4*c* (see FIG. 4). In these four spaces are detachably mounted four ink cartridges 2*a*, 2*b*, 2*c*, 2*d* (collectively referred to as "ink cartridges 2") filled with black ink, cyan ink, magenta ink, and yellow ink. The ink inside the ink cartridges 2 is supplied to the print head 3. The ink cartridge 2*a* filled with black ink has a larger capacity than the other ink cartridges 2*b*, 2*c*, 2*d* filled with the other three colors of ink, taking into account that black ink is used more frequently than the others.

Although not shown in the drawings, the print head 3 has a nozzle surface formed with a plurality of nozzles defining nozzle lines in a lengthwise direction indicated by an arrow T, and performs a prescribed printing operation by selectively ejecting ink droplets through the nozzles onto the recording sheet P. This printing operation is performed by alternately and repeatedly executing one-pass printing for printing one-pass-worth of image with the print head 3 and a line-feed operation for feeding the recording sheet P in the direction A by a distance equivalent to the one-pass-worth of image. A print region covered in the one-pass printing is within a region having a length of the nozzle lines in the conveying direction of the recording sheet P (that is, the lengthwise direction T) and a maximum printing width in the widthwise direction W of the recording sheet P. Accordingly, the recording sheet P is moved a distance in each line-feed operation equivalent to the length of the nozzle lines.

The drive unit 6 includes a carriage shaft 9 engaging the bottom end of the carriage 5 and extending parallel to the platen roller 7, a guide plate 10 engaging the top end of the carriage 5 and extending parallel to the carriage shaft 9, two pulleys 11 and 12 disposed adjacent to both ends of the carriage shaft 9 between the carriage shaft 9 and the guide plate 10, an endless belt 13 looped around both the pulleys 11 and 12, and a carriage motor 101 disposed adjacent to the pulley 11.

The carriage motor 101 drives the pulley 11 to rotate forward or in reverse. At this time, the carriage 5 attached to the endless belt 13 moves reciprocally in the widthwise direction W along the carriage shaft 9 and the guide plate 10 according to the forward or reverse rotation of the pulley 11.

The purging unit 8 is provided on the right side of the platen roller 7 and opposes the print head 3 when the head unit 4 is in a predetermined reset position. The purging unit 8 includes a purge cap 14, a pump 15, a cam 16, and an ink reservoir 17. The purging unit 8 performs the purging operation when the head unit 4 is in the reset position. That is, the purge cap 14 contacts the nozzle surface of the print head 3 so as to cover the nozzles in the print head 3. The cam 16 drives the pump 15 to draw out defective ink containing air bubbles and the like from the print head 3. The defective ink drawn out of the print head 3 is stored in the ink reservoir 17.

A wiping member 20 is disposed to the left side of the purging unit 8. The wiping member 20 is formed in a spatula shape and wipes the nozzle surface of the print head 3 as the carriage 5 moves across. A cap 18 is positioned adjacent to the purge cap 14 for covering the nozzles in the print head 3 in order to prevent the ink from drying when the print head 3 returns to the reset position after the printing process ends.

Figure 10:
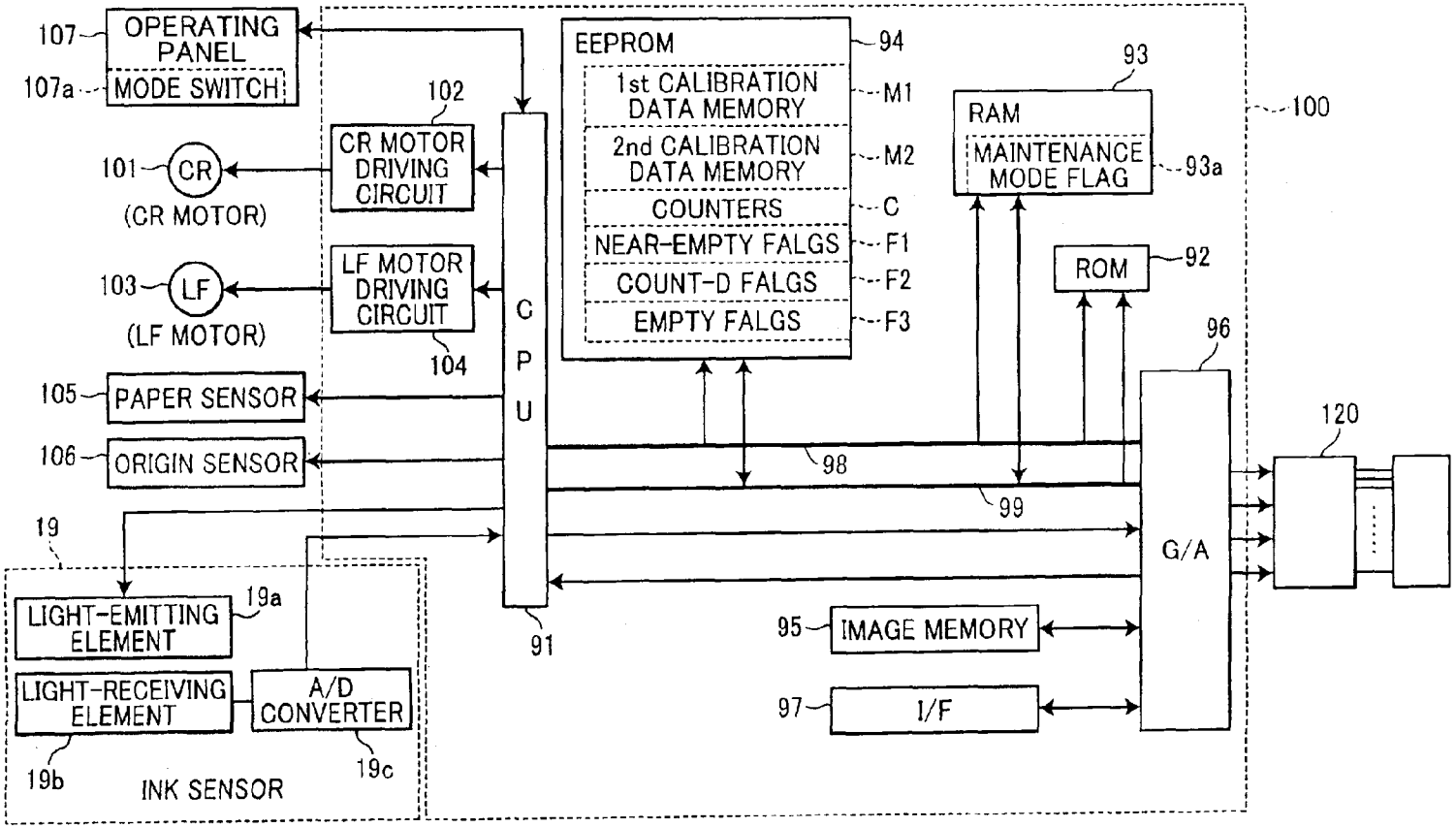
FIG. 10 is a block diagram showing the general configuration of an electrical circuit in the color inkjet printer of FIG. 1.

The ink sensor 19 is disposed near the left end of the drive unit 6 for detecting the existence of the ink cartridges 2 and the existence of ink therein. As shown in FIG. 10, the ink sensor 19 includes an infrared light-emitting element 19*a*, an infrared light-receiving element 19*b*, and an A/D converter 19*c* connected to the infrared light-receiving element 19*b*.

Figure 4:
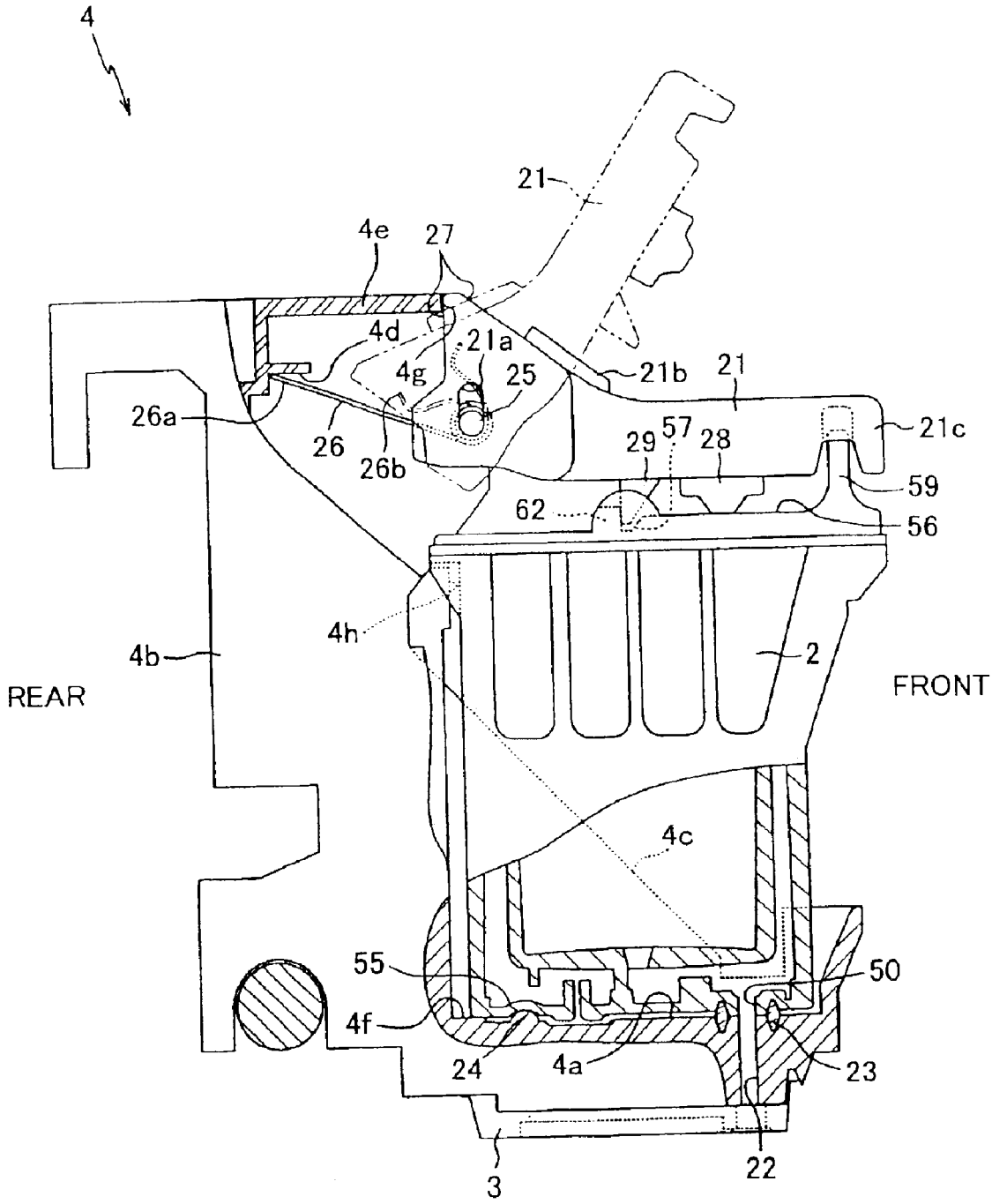
FIG. 4 is a partially cross-sectional side view showing one of the ink cartridges mounted in a head unit of the inkjet printer.

Next, the configuration for fixing the ink cartridges 2 in the head unit 4 will be described with reference to FIGS. 4, 5(*a*), and 5(*c*). FIG. 4 is a side view showing one of the ink cartridges 2 mounted in the head unit 4 with a partial cross-sectional view. FIG. 5(*a*) is a cross-sectional side view of the ink cartridge 2. FIG. 5(*c*) is a perspective view showing the bottom of the ink cartridge 2.

As shown in FIG. 5(*a*), the ink cartridge 2 have a bottom wall 46 and a top wall 56. As shown in FIGS. 5(*a*) and 5(*c*), the bottom wall 46 is formed with a first engaging depression 55, an air hole 47, and an ink supply port 50 in order, beginning from the rear side. The first engaging depression 55 is formed approximately in the center of the ink cartridge 2 in the widthwise direction W.

As shown in FIG. 5(*a*), the top wall 56 is formed with a first upper wall 56*a*, a first protrusion 62, a second engaging depression 57, a second upper wall 56*b*, and a handgrip 59 in order, beginning from the rear side. The first upper wall 56*a* is formed at a height from the bottom wall 46 lower than that of the second upper wall 56*b*. The first protrusion 62 protrudes upward and forms the back wall of the second engaging depression 57. The handgrip 59 protrudes upward to provide a member that a user can easily grab when mounting and removing the ink cartridge 2 in and from the head unit 4.

As shown in FIG. 4, the mounting unit 4*a* is formed with a protrusion 4*f*, an engaging protrusion 24, and an ink supply channel 22 in order, beginning from the rear side. More specifically, the protrusion 4*f* is formed on the rear side of the mounting unit 4*a* for restricting vertical movement of the ink cartridge 2. The engaging protrusion 24 protrudes from the mounting unit 4*a* on the front side of the protrusion 4*f*. The engaging protrusion 24 engages the first engaging depression 55 formed in the bottom wall 46 of the ink cartridge 2 to fix the position of the ink cartridge 2. The ink supply channel 22 is formed in the front portion of the mounting unit 4*a* penetrating to the print head 3, enabling the ink supply channel 22 and the ink cartridge 2 to be in fluid communication with each other. An O-ring 23 is disposed in a circular channel, which is formed around the periphery of the ink supply channel 22 and the ink supply port 50, for sealing the ink supply channel 22. In this configuration, ink is supplied from the ink cartridge 2 to the print head 3 while the ink supply channel 22 is sealed by the O-ring 23.

Accurate positioning is not possible with this connection between the ink supply channel 22 and the ink supply port 50 alone, as the ink cartridge 2 will rotate about the ink supply port 50 (O-ring 23) due to inertia generated by the moving carriage 5. However, this rotation is prevented in the present embodiment by the engagement of the engaging protrusion 24 on the head unit 4 and the first engaging depression 55 on the bottom wall 46 as described above, thereby fixing the position of the ink cartridge 2. As a result, the ink cartridge 2 can be accurately fixed on the head unit 4.

An upper cover 4*e* and a locking arm 21 are disposed on top of the head unit 4. The upper cover 4*e* has an engage part 4*d* and an end portion 4*g*. The locking arm 21 is for locking the ink cartridge 2 and rotatably supported by a swinging shaft 25 at one end. An auxiliary spring member 26 is wound around the swinging shaft 25 for urging the locking arm 21 upward. One end 26*a* of the auxiliary spring member 26 is engaged with the engaging part 4*d* on the head unit 4, and another end 26*b* is fixed to the locking arm 21.

A stopper 27 having a triangular shape in side view is formed protruding from the rear end of the locking arm 21. A pressing unit 28 is formed to protrude from the bottom surface of the locking arm 21. The pressing unit 28 is capable of receding with respect to the locking arm 21, but is urging to protrude by a compression spring (not shown) disposed in the pressing unit 28 in an elastically compressed state.

When the locking arm 21 is closed as represented by a solid line in FIG. 4, the stopper 27 engages the end portion 4*g* of the upper cover 4*e*, and the top wall 56 of the cartridge 2 contacts the pressing unit 28 causing the pressing unit 28 to recede upward, resisting the urging force of the compression spring. With this construction, the pressing unit 28 applies an urging force on the ink cartridge 2 according to the stopper 27 and the compression spring, pushing downward on and fixing the ink cartridge 2.

An engaging pawl 29 is fixed to the bottom surface of the locking arm 21 behind the pressing unit 28. The engaging pawl 29 engages in the second engaging depression 57 formed in the top wall 56 for fixing the position of the ink cartridge 2 without contacting the bottom end of the second engaging depression 57. Because the first protrusion 62 protrudes upward and forms the back wall of the second engaging depression 57 as described above, when the engaging pawl 29 engages in the second engaging depression 57, the first protrusion 62 prevents the ink cartridge 2 from shifting backward and from floating upward. Here, the second engaging depression 57 for engaging the engaging pawl 29 is disposed at a position corresponding to approximately the center in the thickness direction T and between the ink supply port 50 and the first engaging depression 55. Hence, the ink cartridge 2 is supported with good balance at three points, namely the second engaging depression 57, the ink supply port 50, and the first engaging depression 55. Accordingly, this configuration can prevent the ink cartridge 2 from rising up, leaning in one direction, or vibrating, thereby fixing the ink cartridge 2 on the head unit 4 in a stable state.

As shown in FIG. 5(*a*), a pair of opposing side plates 58 (only one is shown) are provided one on each widthwise side of the second engaging depression 57. The space between the side plates 58 is approximately equivalent to the width of the engaging pawl 29. Hence, when the engaging pawl 29 is fitted into the second engaging depression 57, the pair of side plates 58 prevents the ink cartridge 2 from moving (deviating) in the widthwise direction W.

Since the head unit 4 is moved reciprocally during a printing operation while being abruptly accelerated and decelerated repeatedly, the ink cartridge 2 may deviate horizontally in the moving direction W. Such horizontal deviation may generate vibrations in the head unit 4 itself and have adverse effects on the printing quality. However, since the pair of side plates 58 prevent deviation (vibration) of the ink cartridge 2 in the moving direction W, the head unit 4 can move smoothly back and forth without vibrating, thereby maintaining a good printing quality.

A pair of ribs 61 (only one is shown) is also provided on the back of the ink cartridge 2. The ribs 61 oppose each other and are formed with the same prescribed interval as the side plates 58. An engaging protrusion 4*h* (see FIG. 4) protrudes from the head unit 4 at a position corresponding to the pair of ribs 61. When the ink cartridge 2 is mounted in the head unit 4, the engaging protrusion 4*h* fits into the interval between the ribs 61. Accordingly, this pair of ribs 61 prevents the ink cartridge 2 from deviating (vibrating) horizontally during the printing process also.

By not configuring the entire top wall 56 in a thin construction, it is possible to maintain rigidity in the top wall 56 to withstand pressure from the pressing unit 28.

A protrusion 21*b* is also formed on the locking arm 21. By pushing down on the protrusion 21*b*, the locking arm 21 slides downward along an elongated hole 21*a*, thereby disengaging the upper cover 4*e* and the stopper 27. The locking arm 21 springs upward by the urging force of the auxiliary spring member 26 and is maintained in the open position described by dotted lines. This configuration allows a wide space to be opened in the region that the ink cartridge 2 is mounted in the head unit 4, thereby improving the facilitating maintenance of the inkjet printer 1 for a user installing or removing an ink cartridge 2. Here, the elongated hole 21*a* is formed of sufficient length to enable the stopper 27 to disengage from the upper cover 4*e*.

By gripping the handgrip 59, a single ink cartridge 2 can be removed from the head unit 4 without interference from neighboring ink cartridges 2. Likewise, when mounting an ink cartridge 2 in the head unit 4, the ink cartridge 2 can be easily mounted in its narrow space by gripping the ink cartridge 2 by the handgrip 59.

When mounting the ink cartridge 2, the back portion of the ink cartridge 2, that is the first upper wall 56*a* side, is inserted first into the prescribed position in the head unit 4. As described above, however, the first upper wall 56*a* is formed lower than the second upper wall 56*b*, thereby preventing interference between the first upper wall 56*a* and the pivoting portion of the locking arm 21 (the side near the stopper 27). Hence, the ink cartridges 2 can be easily mounted without catching on the head unit 4.

To return the locking arm 21 to its closed position, the operator simply presses down on a free end 21*c* of the locking arm 21. By pushing down on the free end 21*c*, the locking arm 21 swings down around the swinging shaft 25 until the pressing unit 28 contacts the top wall 56. By pushing further down on the free end 21*c*, the locking arm 21 rotates about the contact point between the pressing unit 28 and the top wall 56, forcing the stopper 27 positioned below the upper cover 4*e* to move right of the end portion 4*g*. At this point, the locking arm 21 is pushed upward along the elongated hole 21*a* by the urging force of the auxiliary spring member 26 and engages the end portion 4*g*.

Next, the internal structure of the ink cartridge 2 will be described with reference to FIGS. 5(*a*) and 5(*b*). FIG. 5(*a*) shows the state of the ink cartridge 2 filled with no ink. FIG. 5(*b*) is a cross-sectional view taken along a line Vb—Vb of FIG. 5(*a*).

As shown in FIG. 5(*a*), the ink cartridge 2 is hollow with a substantial box shape. In addition to the bottom wall 46 and the top wall 56 mentioned above, the ink cartridge 2 has side walls 51 and 60. Partitions 41 and 42 are provided inside the ink cartridges 2 for partitioning the ink cartridge 2 into an air introduction chamber 43, a main ink reservoir 44, and a sub ink reservoir 45. The air introduction chamber 43 is in fluid communication with the air outside the ink cartridge 2 via the air hole 47. The top of the air introduction chamber 43 is in fluid communication with the main ink reservoir 44, enabling air to be introduced into the main ink reservoir 44.

The main ink reservoir 44 is an essentially airtight space for storing ink. Foam 48, which is made of porous material, is accommodated in the main ink reservoir 44 in a compressed state. The foam 48 is a porous member formed of a sponge, a fibrous material, or the like that is capable of retaining ink due to the capillary effect. Even if the ink cartridge 2 is inverted, for example, this configuration can prevent ink from flowing from the main ink reservoir 44 to the air introduction chamber 43 and leaking out of the ink cartridge 2 through the air hole 47. An ink channel 49 is formed in the partition 42 at the bottom of the main ink reservoir 44, enabling the main ink reservoir 44 to be in fluid communication with the sub ink reservoir 45.

The sub ink reservoir 45 is an essentially hermetically sealed space on the front of the ink cartridge 2 for storing ink. Ink stored in the main ink reservoir 44 and the sub ink reservoir 45 is supplied to the print head 3 via the ink supply port 50 as described above.

The side wall 51 that forms a front wall of the sub ink reservoir 45 is formed of a transparent light-permeable material. Examples of the light-permeable materials that can be used in this embodiment include acrylic resin, polypropylene, polycarbonate, polystyrene, polyethylene, polyamide, methacryl, methyl pentene polymer, and glass. The term transparent used above does not necessarily mean perfectly optically transparent, but can include the meaning translucent as well.

The side wall 51 includes a sloped portion 51*a*, which slopes downward toward the main ink reservoir 44 at approximately 20 degrees to the vertical and serves as light-permeable window. Prisms 52 are integrally formed along an inner surface of the sloped portion 51*a* spanning nearly the entire widthwise direction W of the sloped portion 51*a*. The prisms 52 are used to detect the existence of ink stored in the ink cartridge 2. Details will be described later.

Figure 8A:
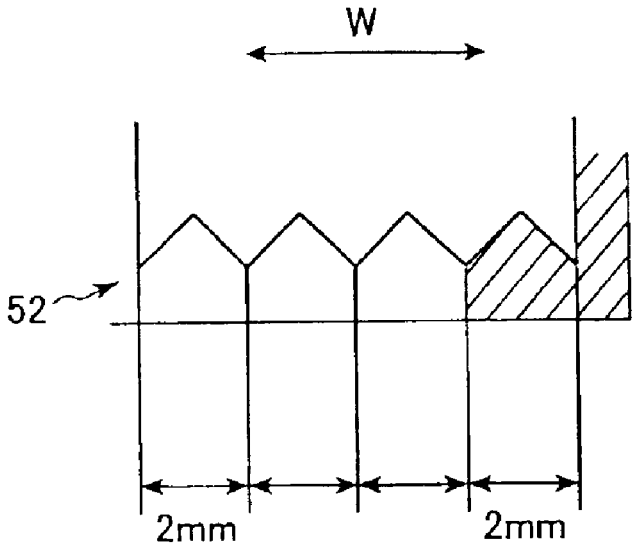
FIG. 8(*a*) is an explanatory diagram showing the shape of the prisms formed on the ink cartridge and the intervals between peaks of the prisms.
Figure 8B:
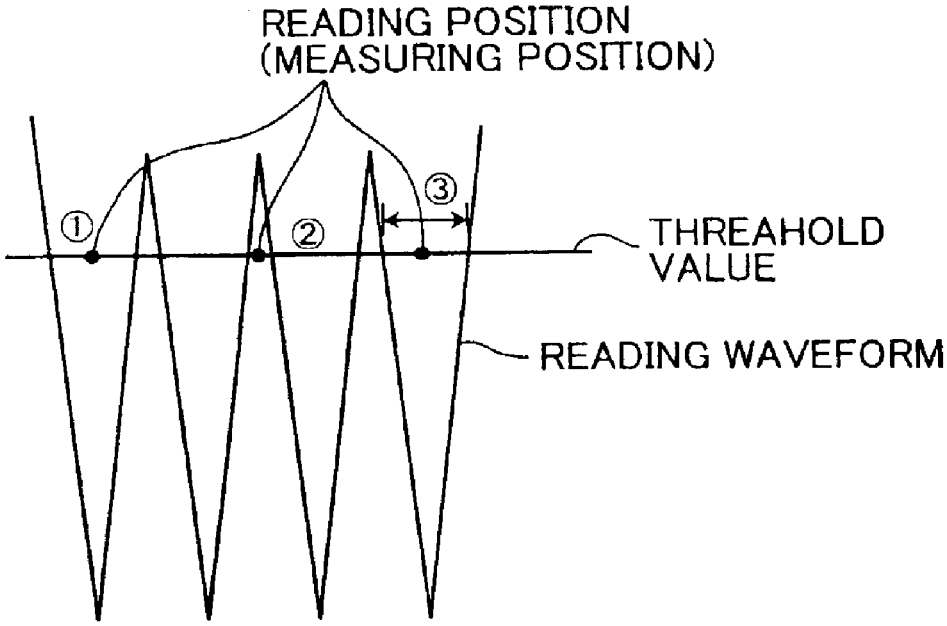

As shown in FIG. 5(*b*), the prisms 52 have a plurality of reflecting surfaces 52*a* by arranging the prisms 52 with alternating peaks and valleys. In the present embodiment, the reflecting surfaces 52*a* intersect with one another at an angle of about 90 degrees. The number of reflecting surfaces 52*a* is between eight and sixteen. The plurality of reflecting surfaces 52*a* are arranged along the widthwise direction W (perpendicular to the paper surface in FIG. 5(*a*)) and slope downward, as does the sloped portion 51*a*. Accordingly, the ink can flow down over the prisms 52, thereby preventing ink from remaining on the prisms 52, as residual ink can prevent a desired reflected light from being obtained from the prisms 52. As shown in FIG. 8(*a*), the valleys of the prisms 52 are formed in the center of the ink cartridge 2 in the widthwise direction W. The interval between peaks or between valleys is set to 2 mm.

Referring to FIG. 5(*a*), a reflecting member 53 is formed on the top of the sub ink reservoir 45 in a manner to oppose the prisms 52 at a prescribed distance for changing the path of infrared light emitted from the ink sensor 19. The reflecting member 53 is formed in a pouch shape having an air pocket 53A in the center, and extends in the vertical direction V at an angle of 20 degrees to the prisms 52 (see FIG. 6(*a*)).

Figure 6A:
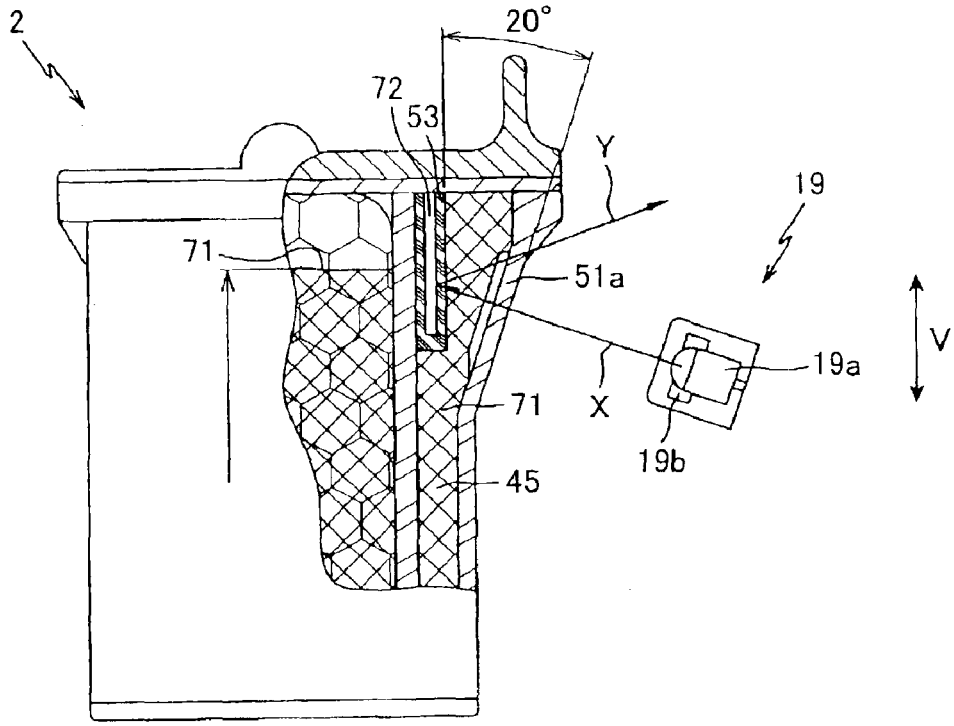
FIG. 6(*a*) is a side view showing the vertical relationship between the ink cartridge of FIG. 4 and an ink sensor and optical paths when the ink cartridge contains sufficient ink.
Figure 6B:
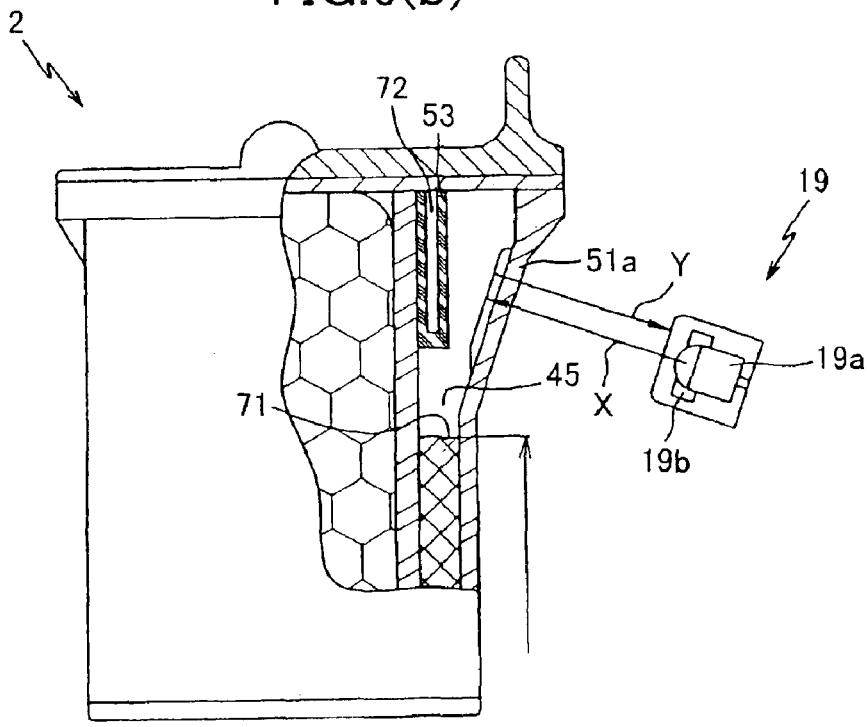

In the ink cartridge 2 having the construction described above, air is introduced from the air introduction chamber 43 into the main ink reservoir 44 when the print head 3 expends ink from the ink cartridge 2 in order to replace the expended ink. Accordingly, the level of ink in the main ink reservoir 44 drops, as shown in FIG. 6(*a*). When ink is further expended until all the ink in the main ink reservoir 44 is used, ink remaining in the sub ink reservoir 45 is supplied to the print head 3. At this time, the sub ink reservoir 45 is decompressed, but air received from the air introduction chamber 43 via the main ink reservoir 44 is introduced into the sub ink reservoir 45 via the ink channel 49, thereby alleviating the decompression in the sub ink reservoir 45 and lowering the level of the ink as shown in FIG. 6(*b*).

That is, the ink cartridge 2 is configured such that first ink in the main ink reservoir 44 is expended and then ink in the sub ink reservoir 45 is expended after all ink in the main ink reservoir 44 has been used. Accordingly, by detecting the existence of ink in the sub ink reservoir 45 using the ink sensor 19, it is possible to determine the existence of ink for the entire ink cartridge 2.

Figure 7A:
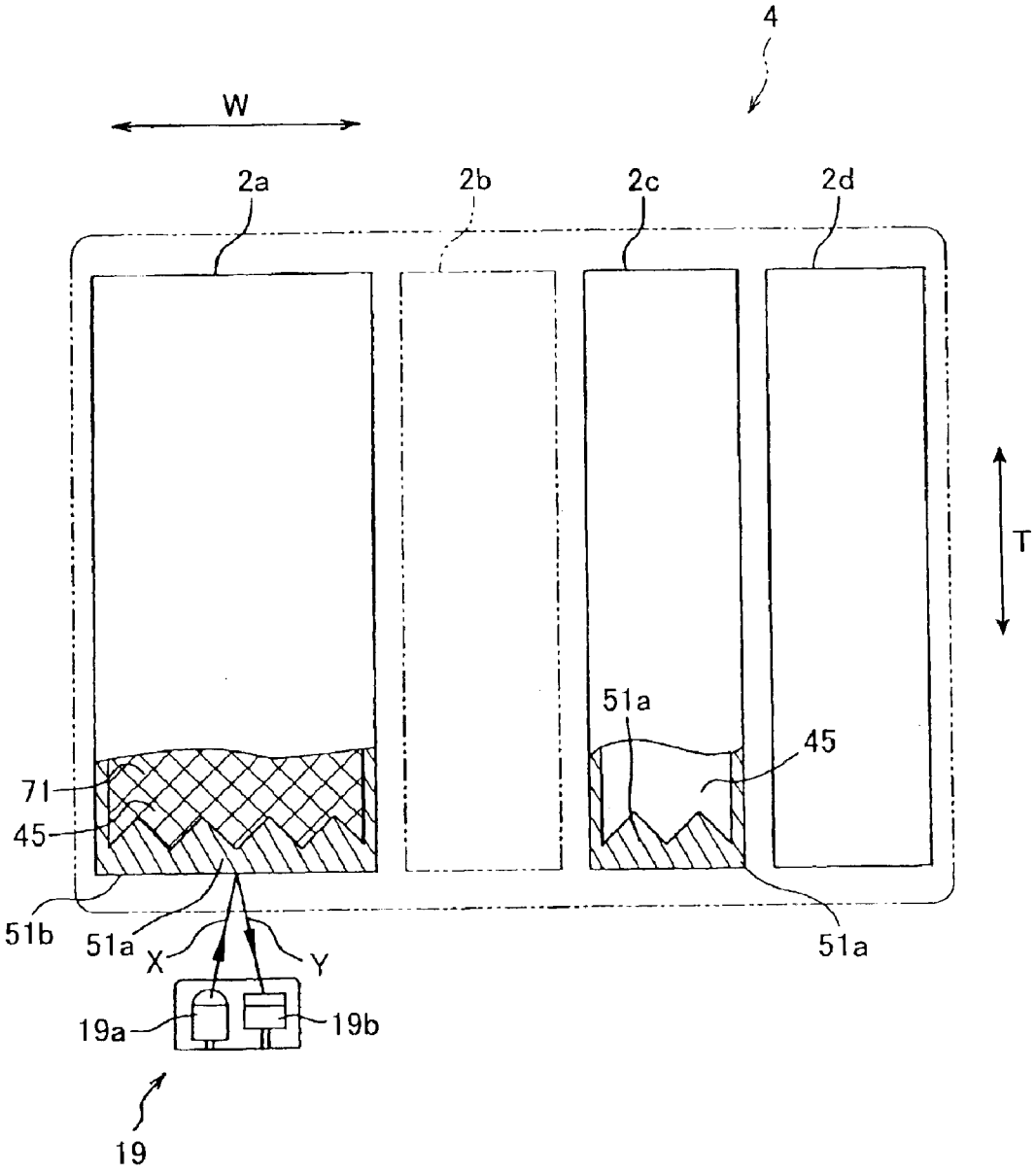
FIG. 7(*a*) is a top view showing optical paths when the ink sensor is positioned in parallel with the ink cartridge with respect to the horizontal direction.
Figure 7B:
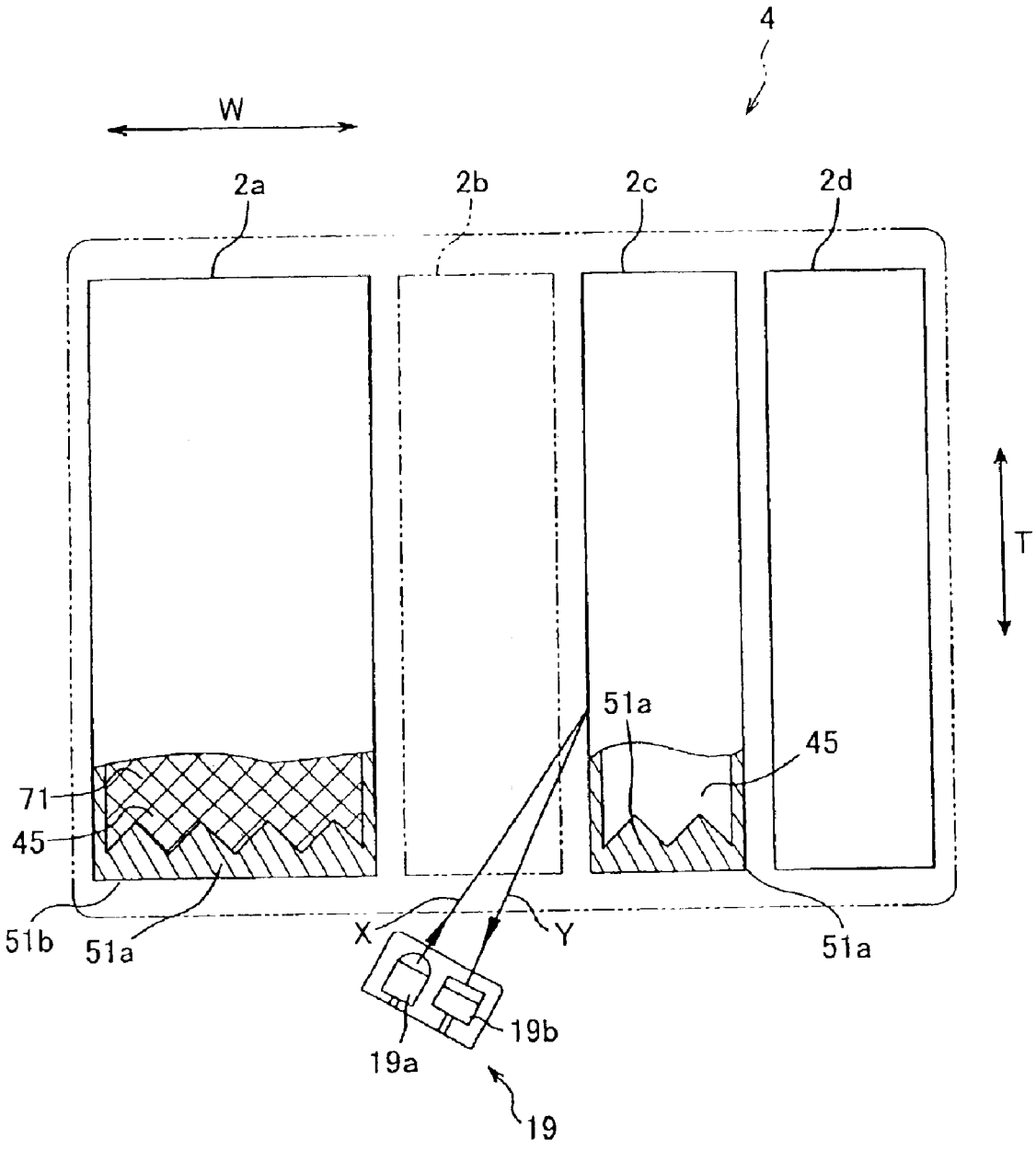
Figure 7C:
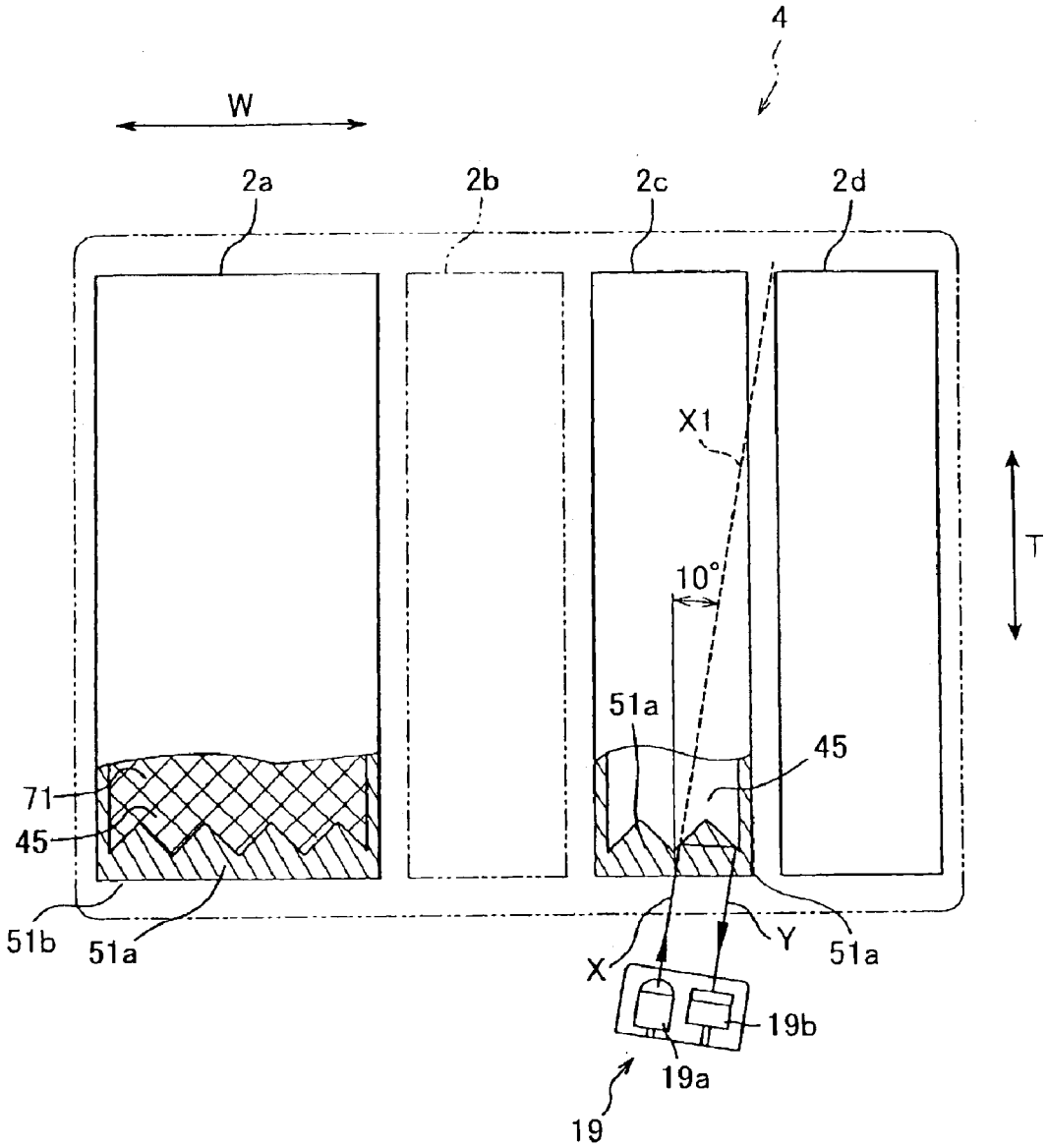

Next, the ink sensor 19 will be described. As described above, the ink sensor 19 includes the infrared light-emitting element 19*a* and the infrared light-receiving element 19*b*. The infrared light-emitting element 19*a* and the infrared light-receiving element 19*b* have an irradiating surface and a receiving surface, respectively. As shown in FIG. 6(*a*), the ink sensor 19 is oriented such that the irradiating and receiving surfaces are slanted at approximately 20 degrees to the vertical direction V, as is the sloped portion 51*a*. The ink sensor 19 is also slanted at an angle of approximately 10 degrees to the sloped portion 51*a* in the widthwise direction W (horizontal direction) as shown in FIG. 7(*c*). An infrared light irradiated from the infrared light-emitting element 19*a* onto the ink cartridge 2 is received as reflected light by the infrared light-receiving element 19*b*. The existence of the ink cartridges 2 and of ink in the ink cartridges 2 can be detected based on the amount of reflected light received.

Next, the principles of detecting the existence of ink and an ink cartridge will be described with reference to FIGS. 6(*a*) and 6(*b*). FIGS. 6(*a*) and 6(*b*) are partial cross-sectional side views showing the ink cartridge 2 and the ink sensor 19. It should be noted that mounting members for the head unit 4 and the ink sensor 19 are omitted from these drawings for illustration purposes.

When the ink cartridge 2 is sufficiently filled with an ink 71 as shown in FIG. 6(*a*), infrared light irradiated from the infrared light-emitting element 19*a* (optical path X) passes through the ink 71 inside the ink cartridge 2. The reason the infrared light passes through the ink 71 is that its index of refraction is very similar to that of the material forming the prisms 52. After passing through the ink 71, the infrared light reaches the reflecting member 53 disposed in the sub ink reservoir 45. Since the refractive index of the material forming the reflecting member 53 is different from that of an air 72 inside the air pocket 53A of the reflecting member 53, the infrared light is reflected off the interface between the inner surface of the reflecting member 53 and the air 72 (optical path Y).

Since the sloped portion 51*a* of the ink cartridge 2 is slanted at approximately 20 degrees to the reflecting member 53, the angle of incidence of the infrared light reaching the reflecting member 53 is different from the angle of incidence of light reaching the side wall 51. Accordingly, light reflected by the reflecting member 53 (optical path Y) is reflected at a different angle from the incident light. Accordingly, the reflected infrared light is not directed toward the infrared light-receiving element 19*b*. As a result, the amount of reflected light directed toward the infrared light-receiving element 19*b* is small.

On the other hand, when there is no ink 71 in the sub ink reservoir 45 as shown in FIG. 6(*b*), the infrared light irradiated from the infrared light-emitting element 19*a* (optical path X) is reflected by the interface between the air inside the sub ink reservoir 45 and the reflecting surface 52*a* of the prisms 52 (optical path Y), because the index of refraction of air is different from that of the material forming the prisms 52. Therefore, there is a large amount of light reflected from the ink cartridge 2 to the infrared light-receiving element 19*b*. When an ink cartridge 2 is not mounted in the head unit 4, the infrared light irradiated from the infrared light-emitting element 19*a* is not deflected by the ink cartridge 2. Accordingly, the infrared light-receiving element 19*b* will receive the amount of reflected light even less than when the ink cartridge 2 is filled with sufficient ink.

Since the amount of light reflected from the ink cartridge 2 (optical path Y) changes according to the existence of ink and ink cartridge 2, it is possible to detect the existence of ink and of the ink cartridge 2 using the infrared light-receiving element 19*b* to detect the difference in amount of reflected light.

Figure 18A:
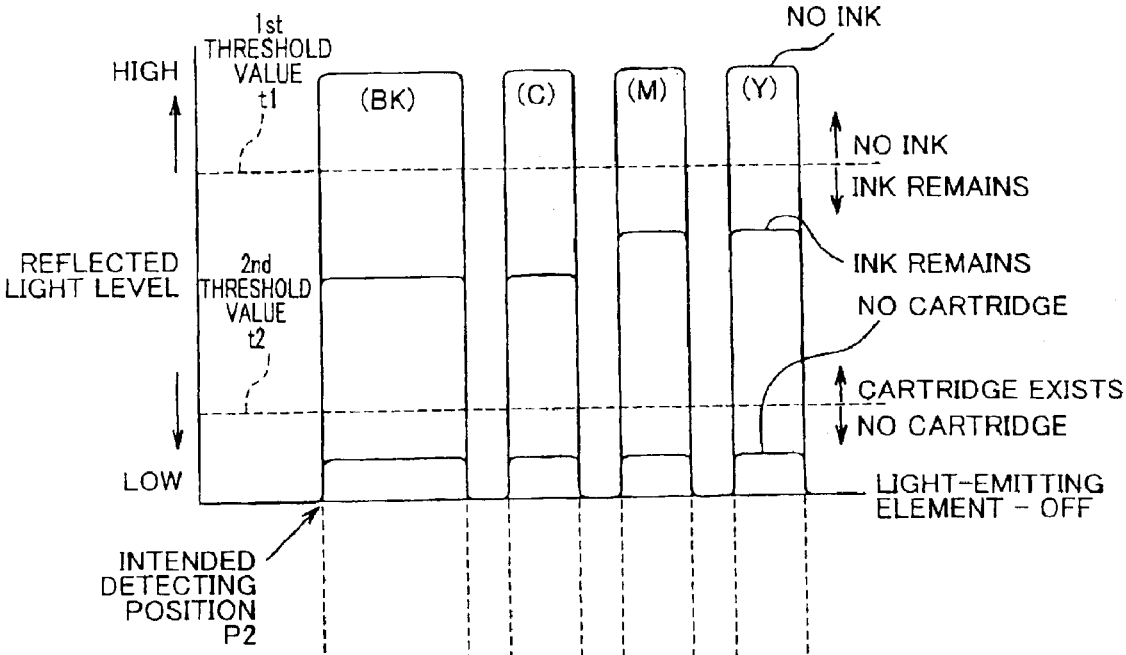
FIG. 18(*a*) is a theoretical graph showing levels of reflected light at an original detecting position.
Figure 18B:
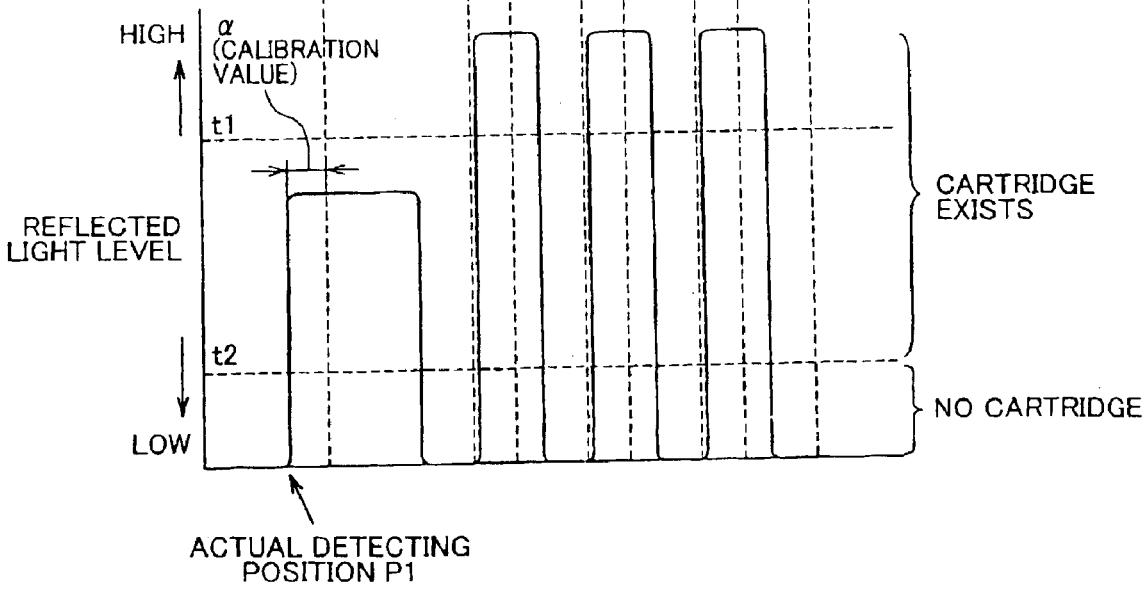

FIG. 18(*a*) graphs variations in the level of light reflected by the ink cartridge 2. The vertical axis indicates the amount of reflected light, growing larger toward the top of the graph. Ink detection is performed using a first threshold value t1 represented by a dotted line, while detection of the ink cartridge 2 is conducted using a second threshold value t2 represented by a dotted line below that for the first threshold value t1. A level of reflected light above the first threshold value t1 indicates that the level of the ink 71 in the sub ink reservoir 45 is below the reflecting member 53, indicating that the ink cartridge 2 is near empty. A level of reflected light between the first threshold value t1 and the second threshold value t2 indicates that the level of the ink 71 in the sub ink reservoir 45 is above the reflecting member 53, indicating that the ink cartridge 2 is full of ink. A level less than the second threshold value t2 indicates that an ink cartridge 2 is not mounted in the head unit 4. In this manner, it is possible to detect the existence of ink by comparing the level of reflected light (signal waveform) to the first threshold value t1 and to detect the existence of the ink cartridge 2 by comparing the level of reflected light to the second threshold value t2 because there is an obvious difference in reflected light when ink exists or not and when an ink cartridge 2 is mounted or not.

In general, the infrared light emitted from the infrared light-emitting element 19*a* has a prescribed beam angle (about ±10 degrees). Therefore, as the beam of infrared light spreads, the amount of light per unit area irradiated on the sloped portion 51*a* decreases. In the present embodiment, however, the prisms 52 with the plurality of reflecting surfaces 52*a* cover nearly the entire width of the sloped portion 51*a*. Accordingly, the irradiated infrared light can be reflected efficiently, and sufficient amount of reflected light can be received by the infrared light-receiving element 19*b*.

Next, the reason for disposing the ink sensor 19 at an angle of approximately 10 degrees to the horizontal in relation to the sloped portion 51*a* will be described with reference to FIG. 7. FIG. 7 is a top view of the ink cartridge 2 and the ink sensor 19. The ink cartridges 2*a*–2*d* mounted in the head unit 4 are conveyed reciprocally in the widthwise direction W.

When the ink sensor 19 is positioned parallel to the sloped portion 51*a* as shown in FIG. 7(*a*), light emitted from the infrared light-emitting element 19*a* (optical path X) passes through the sloped portion 51*a*. However, the fine irregularity of an external surface 51*b* on the sloped portion 51*a* sometimes reflects the incident light (optical path X) that is expected to penetrate the sloped portion 51*a*. Light reflected in this way (optical path Y) is received by the infrared light-receiving element 19*b*. The infrared light-receiving element 19*b* may determine that the sub ink reservoir 45 is out of ink 71 even though the sub ink reservoir 45 contains the ink 71, a problem that can adversely affect the precision of detecting ink.

When the ink sensor 19 is oriented at an angle larger than about 10 degrees to the sloped portion 51*a* as shown in FIG. 7(*b*), light emitted from the infrared light-emitting element 19*a* (optical path X) is sometimes reflected by the neighboring ink cartridge 2*c*, even when the ink cartridge 2*b* is not mounted on the head unit 4. When this reflected light (optical path Y) is received by the infrared light-receiving element 19*b*, the infrared light-receiving element 19*b* may determine that an ink cartridge 2*b*, for example, exists even when this is not true. Therefore, detection of the ink cartridge 2*b* is unreliable.

When the ink sensor 19 is oriented at about 10 degrees to the sloped portion 51*a* as shown in FIG. 7(*c*), it is possible to suppress light reflected by the external surface 51*b* (optical path Y in FIG. 7(*a*)) from being received by the infrared light-receiving element 19*b* because the infrared light-receiving element 19*b* is slanted. Accordingly, the light passes through the sloped portion 51*a* when ink 71 exists, and is not received by the infrared light-receiving element 19*b*. However, when there is no ink, the infrared light-receiving element 19*b* receives light reflected from the reflecting surface 52*a* (optical path Y). Hence, it is possible to determine the existence of ink accurately according to differences in amount of reflected light. When the ink cartridge 2*c*, for example, is not mounted in the head unit 4, light emitted from the infrared light-emitting element 19*a* does not irradiate the neighboring ink cartridge 2*d* (optical path X1). Hence, it is possible to determine the existence of the ink cartridge 2*c* accurately:

As described above, the prisms 52 are provided on the inner surface of the sloped portion 51*a*. Also, the infrared light is irradiated onto the sloped portion 51*a* in a non-perpendicular direction. Hence, the infrared light-receiving element 19*b* is prevented from receiving a reflected light unrelated to the existence of ink that is reflected by the external surface 51*b* of the sloped portion 51*a*. Accordingly, the noise signal (unnecessary reflected light) is reduced, thereby improving the accuracy of detecting the existence of ink.

FIG. 10 is a block diagram showing the general configuration of an electrical circuit in the inkjet printer 1. As shown, the inkjet printer 1 includes a main controller substrate 100 and a carriage substrate 120. Mounted on the main controller substrate 100 are a single-chip microcomputer serving as a central processing unit (CPU) 91, a read only memory (ROM) 92, a random access memory (RAM) 93 for temporarily storing various data and the like, an electrically erasable read only memory (EEPROM) 94, which is a rewritable nonvolatile memory, an image memory 95, a gate array 96, an interface 97, and the like. An address bus 98 and a data bus 99 connect the CPU 91, the ROM 92, the RAM 93, the EEPROM 94, and the gate array 96.

The CPU 91 generates a print timing signal and a reset signal and transfers the signals to the gate array 96. Connected to the CPU 91 are the operating panel 107 with which the user can input a print command, a motor drive circuit 102 for driving the carriage (CR) motor 101 connected thereto, a motor drive circuit 104 that activates a line feed motor 103 to drive the conveying roller 200, a paper sensor 105 for detecting an leading edge of the recording sheet P, an origin sensor 106 for detecting the carriage 5 located at a predetermined point of origin, the infrared light-emitting element 19*a*, the A/D converter 19*c*, and the like. The CPU 91 controls operations of each component connected thereto.

The ROM 92 stores control programs that are controlled by the CPU 91. The programs include programs for a calibration data input process (FIG. 12), a calibration process (FIG. 14), an ink detection process (FIG. 16), an ink cartridge detection process (FIG. 17), and the like. These programs will be described in detail later. In addition, the ROM 92 stores various fixed data, such as the above-described first and second threshold values t1 and t2.

The RAM 93 is provided with a maintenance mode flag 93*a*, which is turned ON by a user operating the mode switch 107*a* provided in the operating panel 107. The maintenance mode flag 93*a* in the ON condition indicates that the operating mode of the inkjet printer 1 is in a maintenance mode for executing calibrations. The maintenance mode flag 93*a* is set to OFF at the end of the calibrations. The calibration data input process of the present invention, which is one of the calibrations, is executed only when the maintenance mode flag 93*a* is ON.

The EEPROM 94 includes a first calibration data memory M1, a second calibration data memory M2, counters C, near-empty flags F1, count-d flags F2, and empty flags F3. The first calibration data memory M1 is for storing as calibration data a calibration value $\alpha$ that is obtained through the calibration data input process (described later) The calibration data $\alpha$ can be stored in the first calibration data memory M1 only when the maintenance mode flag 93*a* is ON. The second calibration data memory M2 is for storing an adjustment value obtained through the calibration data input process (described later).

The counters C are memories for corresponding ones of four ink cartridges 2 and serve to count the number of ink ejections from the print head 3. A counter value of each counter C is set to 0 when a corresponding ink cartridge 2 is replaced, and is incremented one for each ejection of ink. It is possible to know the approximate amount of expended ink by counting the amount of ink ejections.

A prescribed amount of ink is ejected from the ink cartridge 2 not only during printing, but also during purging and flushing operations. The purging operation is for purging air bubbles in the ink cartridges 2 along with ink. The flushing operation ejects ink in order to clear out blockage in the print head 3. The amount of ink expended during the purging and flushing operations is known in terms of the number of ink ejections and is prerecorded as a prescribed count value in the ROM 92. Accordingly, when the purging operation or the flushing operation is performed, the equivalent prescribed count is added to the counters C to update the count value.

Each of the near-empty flags F1 corresponds to one of the four ink cartridges 2. Each near-empty flag F1 is set to OFF when it is detected that a corresponding ink cartridge 2 is full of ink when, for example, the ink cartridge 2 is exchanged. The near-empty flag F1 is set to ON when the ink sensor 19 detects no ink in the corresponding ink cartridge 2, indicating that the corresponding ink cartridge 2 is near empty. In other words, when the ink level in the sub ink reservoir 45 drops below the reflecting member 53, the amount of reflected light detected by the ink sensor 19 changes greatly (increases). Since the amount of reflected light detected is inputted into the CPU 91 as a signal, the CPU 91 recognizes this change and sets the corresponding near-empty flag F1 to ON.

Because the sloped portion 51*a* and the reflecting member 53 are provided at the top of the sub ink reservoir 45, when the ink sensor 19 detects no ink, resulting in the corresponding near-empty flag F1 being set to ON, the corresponding ink cartridge 2 is not yet completely out of ink. In other words, near empty indicates the limit of the ink sensor 19 for detecting ink and does not indicate that the ink cartridge 2 is completely empty. Therefore, printing can be continued for a while even after the ink cartridge 2 becomes near empty. Because the sloped portion 51*a* and the reflecting member 53 are provided at the top of the sub ink reservoir 45, it is possible to determine when the ink cartridge 2 is running out of ink at the point ink 71 no longer exists at the top of the sub ink reservoir 45. Therefore, a state of low ink can be detected before all the ink 71 in the ink cartridge 2 is expended.

In the present embodiment, the amount of ink remaining in an ink cartridge 2 after the near empty is first detected is detected by the corresponding counter C. More specifically, when one of the near-empty flags C is set to ON, the count value for the corresponding counter C is reset to 0 and subsequently incremented up to an empty threshold count e, which is stored in the ROM 92, thereby improving the precision for detecting when an ink cartridge 2 is empty. As will be described in detail later, the empty threshold count e is set such that when the count value of the counter C reaches the empty threshold count e, the corresponding ink cartridge 2 is close to empty, but contains sufficient ink for one-page printing.

Each of the empty flags F3 corresponds to one of the four ink cartridges 2. The empty flag E is set to ON when the count value of corresponding counter C reaches the empty threshold count e after the near empty is detected, indicating that the corresponding ink cartridge 2 is empty (close to empty). Each of the count-d flags F2 corresponds to one of the four ink cartridges 2, and is turned ON each time the count value of corresponding counter C reaches a predetermined count d, which is stored in the ROM 92, indicating the timings to execute the ink detection process.

In response to print timing signals transferred from the CPU 91, the gate array 96 outputs, based on the image data stored in the image memory 95, print data (drive signals) for printing images corresponding to the image data on the recording sheet P, a transfer clock CLK synchronizing the input data, a latch signal, a parameter signal for generating a basic printer waveform signal, and an ejection timing signal JET for producing output at fixed periods. These signals are transferred to the carriage substrate 120 on which a head driver is mounted. The gate array 96 also receives image data transferred from external devices, such as computers, via the central interface 97 and stores the image data in the image memory 95. The gate array 96 generates a central data reception interrupt signal based on central data transferred from a host computer or the like via the central interface 97 and transfers this signal to the CPU 91. Signals are transferred between the gate array 96 and the carriage substrate 120 via a harness cable connecting the ink cartridge 2.

The carriage substrate 120 shown in FIG. 10 is for driving the print head 3 using a head driver (drive circuit) mounted thereon. The print head 3 and the head driver are connected by a flexible printed circuit board including a copper plate wiring pattern formed on a polyimide film having a thickness of 50 $\mu$m to 150 $\mu$m. The head driver is controlled via the gate array 96 and applies a drive pulse in a waveform suited to a printing mode to each drive element so that ink is ejected in prescribed amounts from the print head 3.

The infrared light-receiving element 19*b* converts a received reflected light using photoelectric conversion and outputs an electric analog signal. This analog signal has a smaller output voltage the larger the amount of reflected light. The A/D converter 19*c* converts the analog signal to a digital signal through the steps of sampling, quantization, binarization, and the like, and outputs the same to the CPU 91. Then, the CPU 91 reads the levels of the reflected light based on the digital signal and compares the read levels to the first threshold value t1 and the second threshold value t2.

Figure 9:
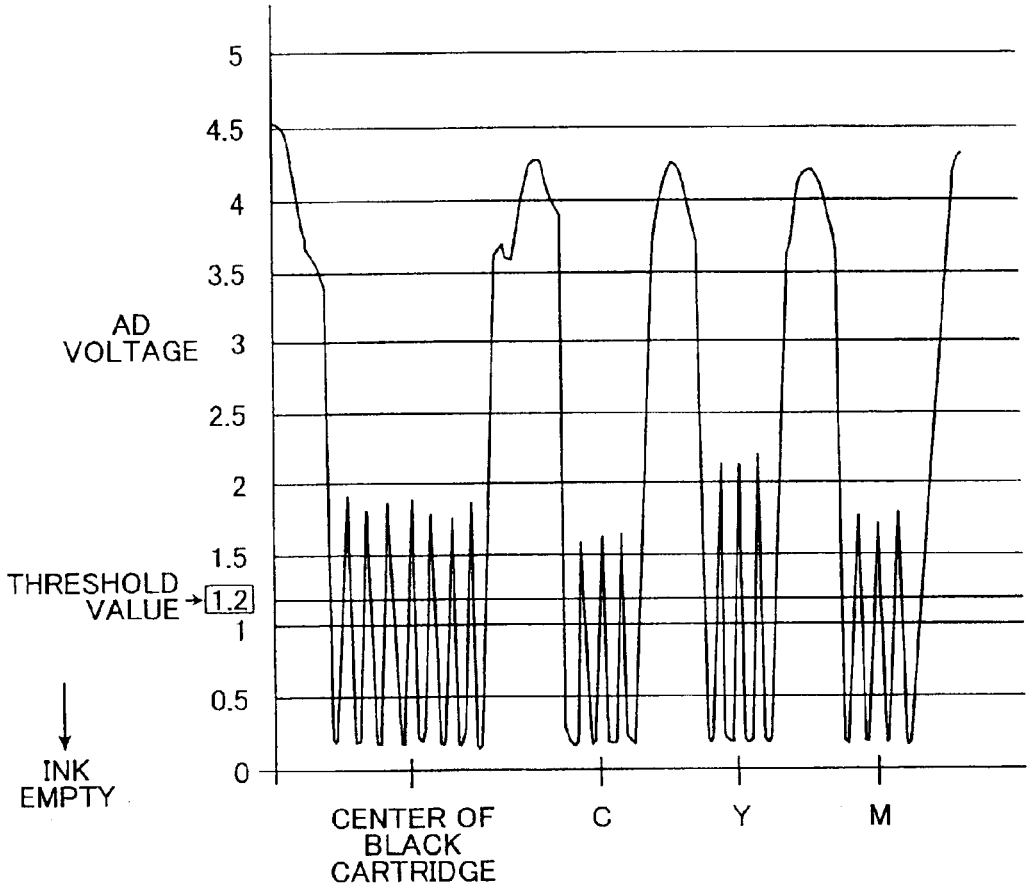
FIG. 9 shows an example of a reading waveform of level of reflected light from the ink cartridges.

It should be noted that because the output voltage of the digital signal is low when the amount of reflected light is great and high when the amount of reflected light is small, there is an inverse relationship between the amount of reflected light shown in FIG. 18(*a*) and the output voltage of the digital signal shown in FIG. 9, which shows an example of the reading waveform for the output voltage of the digital signal corresponding to the light reflected from the ink cartridge 2. More specifically, the amount of reflected light greater than the first threshold value t1 of FIG. 18(*a*) indicates that a corresponding ink cartridge 2 is near empty, whereas the output voltage of the digital signal lower than the threshold voltage value t3 indicates that a corresponding ink cartridge 2 is near empty.

Figure 11:
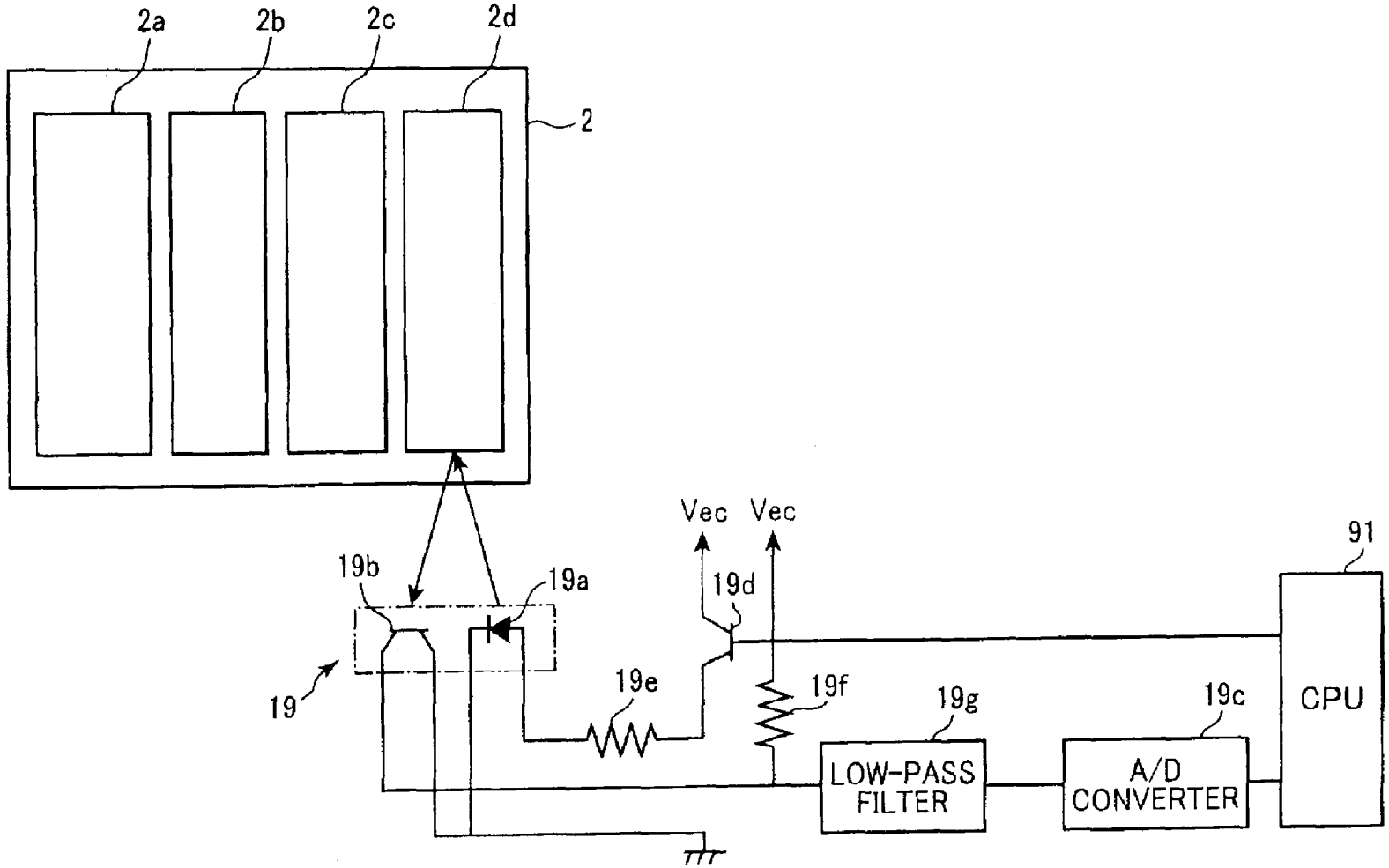
FIG. 11 is a block diagram showing a drive circuit of the ink sensor.

FIG. 11 is a block diagram showing a drive circuit of the ink sensor 19. In addition to the infrared light-emitting element 19*a*, the infrared light-receiving element 19*b*, the A/D converter 19*c*, and the CPU 91, the drive circuit also includes a transistor 19*d* connected to the CPU 91 for turning the infrared light-emitting element 19*a* ON and OFF, a resistor 19*e* for regulating the light-emitting element 19*a*, a load resistor 19*f* for the infrared light-emitting element 19*a*, and a low-pass filter 19*g*.

With this drive circuit, the CPU 91 supplies a PWM signal to the transistor 19*d*, setting the transistor 19*d* ON and OFF in a cycle of from several kHz to several hundred kHz to turn ON and OFF the infrared light-emitting element 19*a*. The infrared light-receiving element 19*b* receives light reflected from the ink cartridge 2, changing the amperage of current flowing from the infrared light-receiving element 19*b* and changing the amount of voltage drop generated by the load resistor 19*f*. When the amount of received light is large, the voltage drop is great. When the amount of received light is small, the voltage drop is small. Accordingly, the voltage at the junction between the load resistor 19*f* and low-pass filter 19*g* varies according to the change in voltage drop. This change in voltage is inputted into the A/D converter 19*c* via the low-pass filter 19*g*. After being converted to a digital value, the signal is read by the CPU 91. Hence, by changing the duty ratio of the PWM signal with the CPU 91, it is possible to adjust the amount of light emitted by the infrared light-emitting element 19*a* and to adjust the output from the infrared light-receiving element 19*b*.

Next, a method to read a reading waveform of output voltage from the ink sensor 19 will be described while referring to FIGS. 8(*a*) and 8(*b*). FIG. 8(*b*) shows a reading waveform of output voltage and reading positions.

In the present embodiment, the existence of ink and ink cartridges 2 are detected by using the single ink sensor 19 while the carriage 5 is moved in a constant speed, so that the reading waveform has a zigzag shape as shown in FIG. 8(*b*), corresponding to the peaks and valleys of the prisms 52 shown in FIG. 8(*a*). The CPU 91 is set to read the output voltages (i.e., level of reflected light) from the reading waveform at three positions, i.e., at the center of the prisms 52 corresponding to a valley and at right and left sides of the center with a fixed reading interval from the center. The reading interval is set not to an integral multiple of the interval between the valleys of the prisms 52, so as to read the levels of the reflected light from positions corresponding to the peaks of the prisms 52. In the present embodiment, the reading interval is set to 1.5 times the interval between valleys of the prisms 52. That is, the reading positions of the present embodiment includes a first reading position ① coinciding with a peak, a second reading position ② coinciding with a valley located at the center of the ink cartridge 2, and a third reading position ③ coinciding with another peak. By setting the reading interval at 1.5 times the interval of valleys in the prisms 52 in this way, it is possible to reliably read the levels of the output voltage from portions of the reading waveform corresponding to the peaks.

After reading the reading waveforms in three positions as described above, the read levels each corresponding to the position ①, ②, ③ is compared to a threshold voltage value t3 corresponding to the first threshold value t1. Then, the determination is made by majority based on these results. In this example, the readings at the positions ① and ② are determined to be less than the threshold voltage value t3, and the reading at the portion ② is determined to be greater than the threshold voltage value t3, so that the ink cartridge 2 is determined to be near empty. Because the voltage levels are read at a plurality of locations of the reading waveform, and because the determination is made by majority based on these results, accurate detection is achieved.

Here, if the reading waveform were read in integral multiples of the interval of valleys in the prisms 52, the output voltages corresponding to only valley portions are read, leading the detector to mistakenly determine that ink exists when there is none.

Also, more than three reading locations could be used to read the reading waveform. In this case also, the intervals between the reading position ② at the center and additional reading positions should be other than an integral multiple of the valley intervals in the prisms 52 so as to read waveforms from peaks in the prisms 52.

Further, the reading interval is not limited to 1.5 times the interval of valleys in the prisms 52. The present invention has been shown to read the reading waveform properly when the reading interval is set larger than the interval of valleys and smaller than two times the interval. With this reading interval, it is possible to read the waveform at interval corresponding to portion of the prism 52 other than the valleys. It has been confirmed from experiments that the reading interval is preferably within a range of 1.3 to 1.7 times the interval of valleys.

Moreover, because the above reading position ② is known to be corresponding to the valley from the beginning, determination could be made based on only the read levels at the positions ① and ③ without taking the read level at the position ② into account or without reading the level at the position ②.

Next, the various processes executed by the inkjet printer 1 will be described with reference to the flowcharts in FIGS. 12 to 17. First, the calibration data input process will be described. This process is performed for the following reasons.

As described above, the ink sensor 19 is oriented at an angle of approximately 10 degrees to the irradiation surface of the ink cartridge 2, that is, the outer surface 51*b* of the sloped portion 51*a*. However, errors often occur when mounting the ink sensor 19, causing the angle to be set differently from the intended 10 degrees. In such a case, the relative positions of the ink sensor 19 and the ink cartridge 2 are different from the intended positions. FIG. 18(*b*) shows the signal waveform for the reflected light level when the mounted angle of the ink sensor 19 deviates from an intended angle with respect to the irradiation surface of the ink cartridge 2. As shown, an actual detecting position P1 has shifted from the intended theoretical detecting position P2 shown in FIG. 18(*a*). When the actual detecting position P1 deviates from the theoretical detecting position P2 in this way, it is not possible to perform accurate detection at the theoretical detecting position P2. In order to overcome such a problem, in the calibration data input process of the present invention, the deviation between the theoretical detecting position P2 and the actual detecting position P1 is calculated, and the amount of deviation is set as a calibration value α and written to the first calibration data memory M1.

There is also irregularity in the sensitivity of the infrared light-receiving element 19*b* for each ink sensor. Therefore, if the infrared light from the infrared light-emitting element 19*a* is set at a fixed amount, the output from the infrared light-receiving element 19*b* may exceed the first threshold voltage value t1 even when there is ink in the ink cartridge 2 for example, leading to a mistaken determination of no ink. In the calibration data input process of the present embodiment, therefore, the amount of light emitted from the infrared light-emitting element 19*a* is adjusted so as to achieve a prescribed output from the infrared light-receiving element 19*b*, using the ink cartridge 2*d* filled with yellow ink only in the sub ink reservoir 45. The ink cartridge 2*d* is used because the yellow ink stored in the ink cartridge 2*d* is the brightest and generates the most reflected light. After adjusting the output from the infrared light-receiving element 19*b* to a prescribed value, the amount of light emission at that time is set as an adjustment value and written to the second calibration data memory M2. In this way, it is possible to absorb irregularities in sensitivity in the ink sensor 19 and to adjust the output from each infrared light-receiving element 19*b* when ink is present to uniform values, irrespective of the ink sensor.

Figure 12:
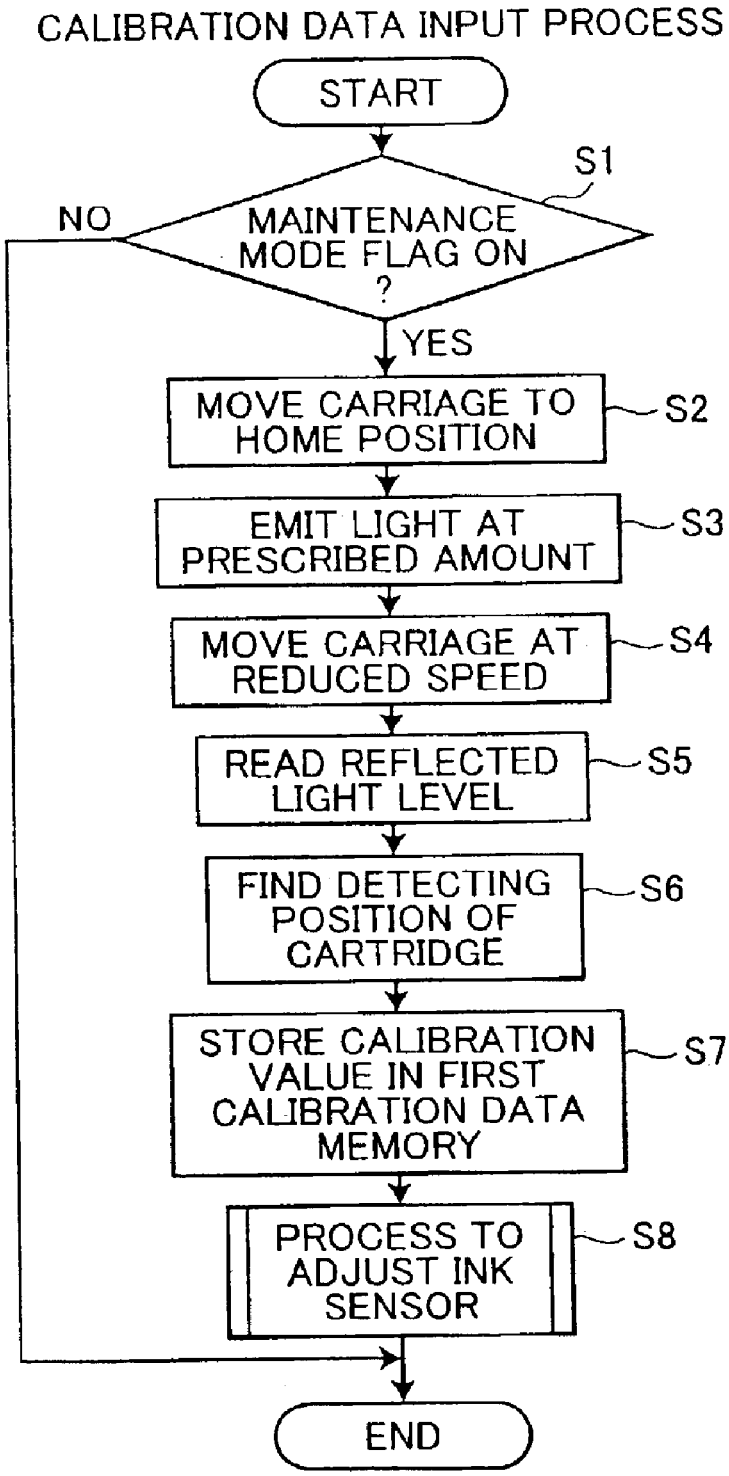
FIG. 12 is a flowchart representing a calibration data input process.

FIG. 12 is a flowchart showing the calibration data input process. This process is executed prior to shipping and includes a process for storing the calibration value α in the first calibration data memory M1 and a process for storing the adjustment value in the second calibration data memory M2. In the present embodiment, the calibration data input process is executed with ink cartridges 2 filled with ink. However, at least the ink cartridge 2*d* for yellow ink is filled with ink only in the sub ink reservoir 45, but not in the main ink reservoir 44.

Below the calibration data input process for storing the calibration value α will be described as a first calibration data input process, and the process for storing the adjustment value will be described as a second calibration data input process.

When the calibration data input process is started, first in S1, it is determined whether or not the maintenance mode flag 93*a* is ON because the calibration data input process is executed only when the operating mode of the inkjet printer 1 is set to the maintenance mode as described above. If the maintenance mode flag 93*a* is OFF (NO:S1), the process is ended. On the other hand, if the maintenance mode flag 93*a* is ON (YES:S1), then after the origin sensor 106 has confirmed the carriage 5 located at the point of origin, the carriage motor 101 is driven to move the carriage 5 a prescribed distance from the point of origin to the home position (S2). Then in S3, the infrared light-emitting element 19*a* starts emitting the infrared light, and the infrared light-receiving element 19*b* starts receiving light reflected from the ink cartridge 2 to detect the amount (level) of reflected light. As described above, the detected amount of reflected light is output as analog signal (FIGS. 18(*a*) and 18(*b*)), converted into a digital signal by the A/D converter 19*c*, and output to the CPU 91. Then in S4, the carriage 5 is moved toward the ink sensor 19 at a speed lower than that during printing process until the carriage 5 reaches a prescribed position, that is, until the carriage 5 has moved a prescribed distance from the point of origin so that the amount of reflected light is detected not only at the theoretical detecting position P2 but also over a range wider than the width of the carriage 5. Then in S5, the CPU 91 reads the levels of the reflected light based on the digital signal from the ink sensor 19. The resultant reading waveform is shown in FIG. 18(*b*).

Then in S6, the actual detecting position P1 indicated in FIG. 18(*b*) is found for the ink cartridge 2*a*, which is a leading cartridge reaching the prescribed position first, based on the level of reflected light. The actual detecting position P1 is detected by sensing the position at which the level of reflected light changes from below the second threshold value t2 indicating that an ink cartridge 2 does not exist to above the second threshold value indicating that an ink cartridge 2 exists.

Next, the difference between the theoretical detecting position P2 (theoretical value) stored in the ROM 92 and the actual detecting position P1 (actual value) is calculated as a moving distance from the point of origin, and is stored as the calibration value α in the first calibration data memory M1 (S7). Here, the theoretical detecting position P2 (theoretical value) is indicated by a distance of the carriage 5 from the point of origin. Accordingly, the actual detecting position P1 is set as P2±α from the point of origin.

The calibration value α is used in the calibration process executed in the second calibration data input process, the ink detection process, and the ink cartridge detection process, so that it is possible to correct the detecting position for detecting the amount of light reflected from the ink cartridge 2, and so the level of reflected light can be detected accurately. This calibration value α is used for calibrating the detection position of not only the ink cartridge 2*a* but also the detection positions of all the ink cartridges 2*a* to 2*d*.

Figure 20:
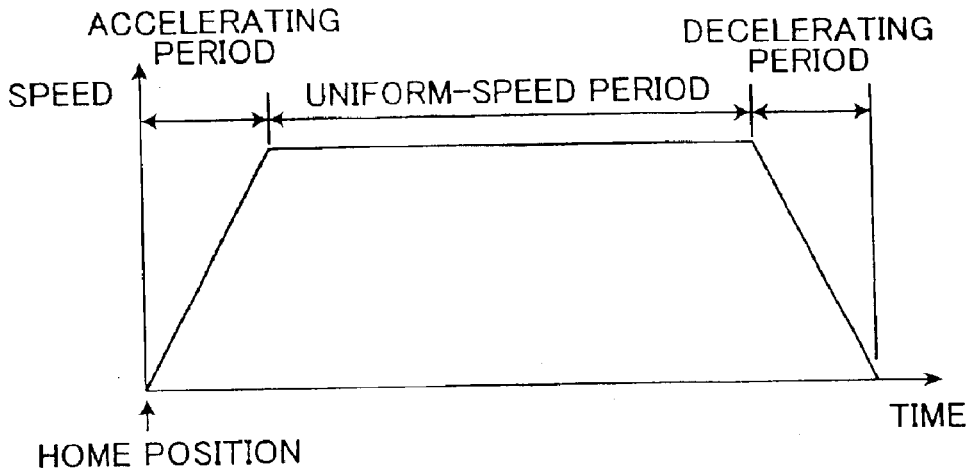
FIG. 20 is a graph showing speed variations of a carriage of the color inkjet printer.

Here, as shown in FIG. 20, after beginning to move from its home position, the carriage 5 undergoes accelerated movement, uniform movement, and decelerated movement. Since the ranges for acceleration and fixed speed are preset, it is possible to determine whether the carriage 5 is moving in its uniform speed interval based on the distance from the home position. In the present embodiment, therefore, the actual detecting position P1 and the theoretical detecting position P2 are preset at positions that are passed during the uniform speed interval.

By setting the positions in this way, the position of light irradiation on the ink cartridge 2 can always be maintained uniformly, thereby improving detection accuracy based on the level of reflected light. Since the ink cartridge 2 will pass the ink detecting position P1 when the carriage 5 is moving at a uniform speed, more accurate ink detection is possible.

As described above, the actual detecting position P1 of the ink cartridge 2 is measured while moving the carriage 5 at a velocity slower than that during the printing process. Since printing is generally conducted at a high speed, the carriage 5 must also be moved reciprocally at a high speed during the printing process. When measuring the actual detecting position P1 while moving the carriage 5 at such a high speed, the amount of reflected light must be detected with a rough sampling and it is difficult to measure the actual detecting position P1 with accuracy. However, in the present embodiment because the actual detecting position P1 is measured while moving the carriage 5 at a speed slower than that during the printing process, precise data sampling can be achieved for the detecting position. Therefore, the detecting position can be accurately adjusted based on the precise data acquired.

After completing the first calibration data input process described above (S1 through S7), the ink sensor adjustment process as the second calibration data input process is executed in S8 to adjust the ink sensor 19. The second calibration data input process is described in detail with reference to the flowchart in FIG. 13.

Figure 13:
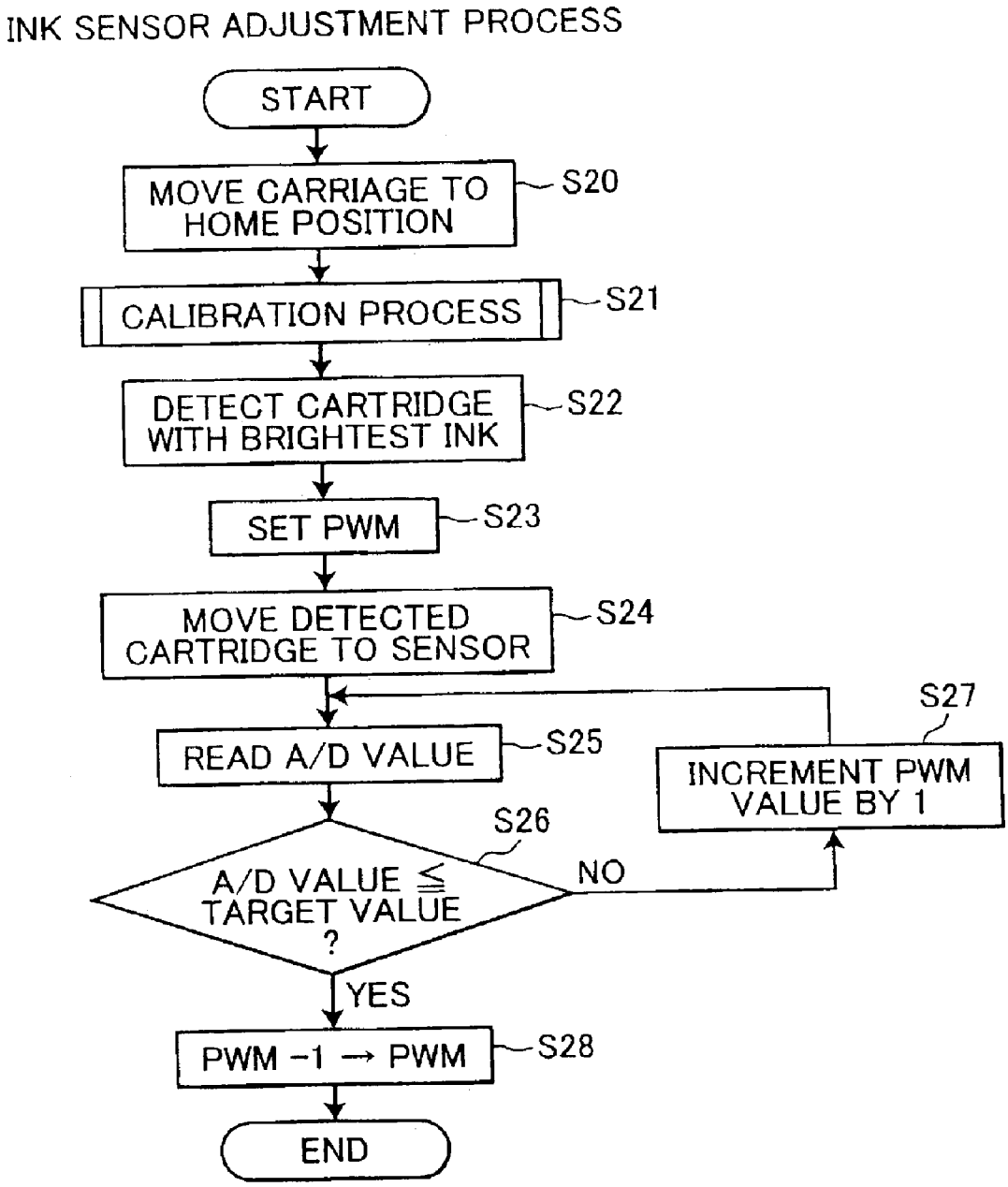
FIG. 13 is a flowchart representing an ink sensor adjustment process.
Figure 19:
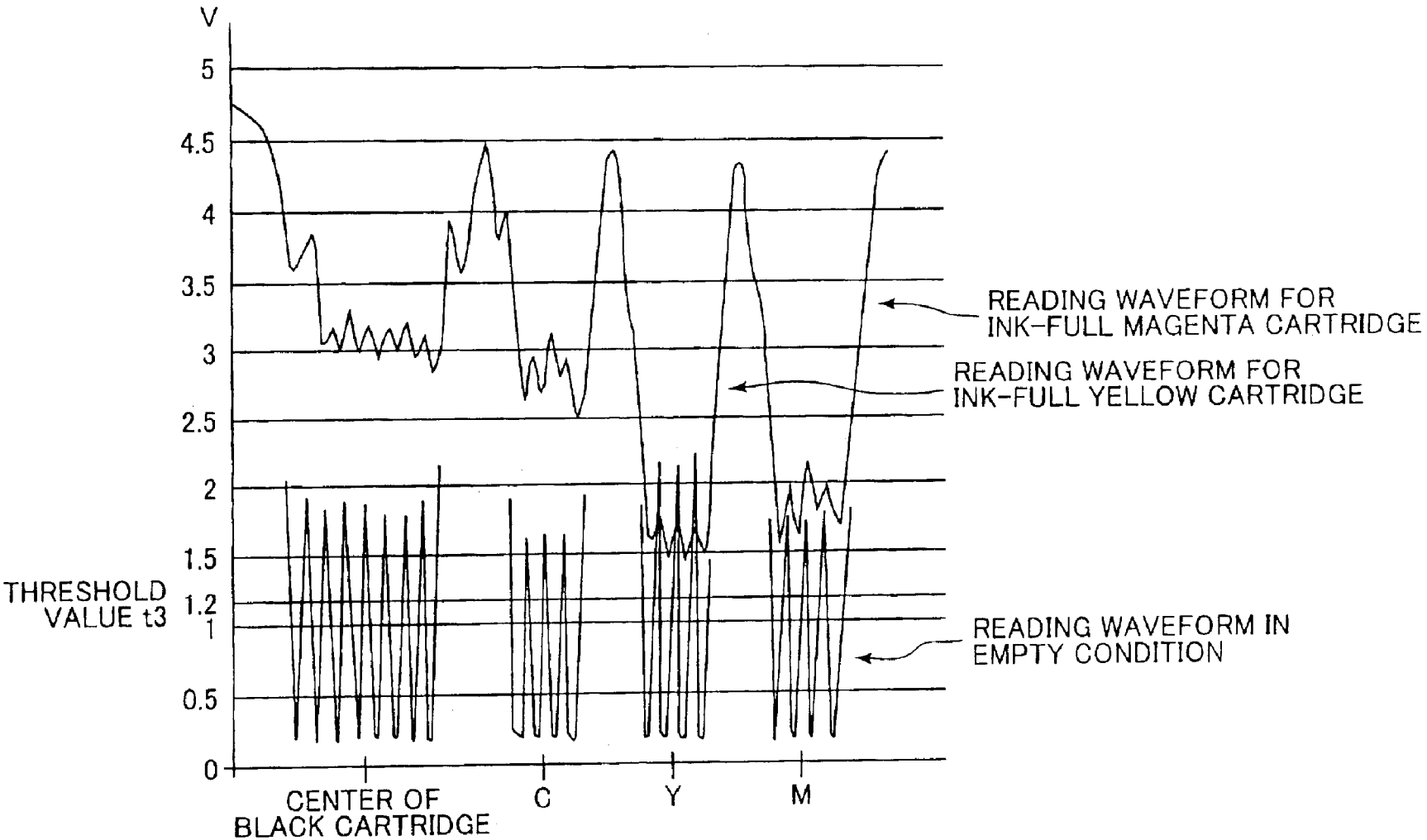
FIG. 19 is reading waveforms read during the ink detection process when each ink cartridge is full and each is empty.

Once the ink sensor adjustment process shown in FIG. 13 is started, the carriage 5 is moved in S20 to the home position. Next in S21, the calibration process is executed to obtain the reading waveform. The detailed description for the calibration process will be described later. Then, in S22, one of the ink cartridges 2 with the brightest color ink, which in this embodiment is the yellow ink cartridge 2*d*, is detected. Because as shown in FIG. 19 the brightest ink cartridge 2 reflects the largest amount of irradiated light, the brightest color ink cartridge can be detected from the reading waveform obtained through the calibration process in S21.

Next, in S23, a value that determines the duty ratio of the PWM signal supplied to the infrared light-emitting element 19*a* is initialized so that the infrared light-emitting element 19*a* will emit a minimum amount of infrared light. The carriage 5 is moved in S24 to a position where an infrared light from the ink sensor 19 will be irradiated on the detected ink cartridge 2, that is, the yellow ink cartridge 2*d* in this example. Then, in S25, the CPU 91 reads the output voltage of the digital signal indicating the level of reflected light for the ink detected cartridge 2*d*. That is, the PWM signal initialized as described above is supplied to the infrared light-emitting element 19*a* so that the infrared light-emitting element 19*a* irradiates an infrared light onto the ink cartridge 2*d*, and the infrared light-receiving element 19*b* outputs an analog signal corresponding to the amount of light reflected from the ink cartridge 2*d*. The analog signal is converted into a digital signal and output to and read by the CPU 91. Since the sub ink reservoir 45 of the yellow ink cartridge 2*d* is filled with ink, as shown in the example of FIG. 19 a corresponding output voltage of the digital signal will be near the threshold voltage value t3, which is set to 1.2 V in this example, corresponding to the first threshold value t1.

Next, the voltage of the digital signal read in S25 is compared to the threshold voltage value t3 in S26. If the voltage is greater than the threshold voltage value t3 (No:S26), then the value that determines the duty ratio of the PWM signal is incremented by one (S27). By incrementing this value by one, the period in which the transistor 19*d* is ON becomes longer, increasing the amount of light emitted from the infrared light-emitting element 19*a*. Then, the process returns to S25 to repeat the same process until a voltage of the digital signal becomes less than or equal to the threshold voltage value t3. When the voltage of the digital signal becomes less than or equal to the threshold value t3 (YES:S26), then the value that sets the duty ratio of the PWM signal is decremented by one and stored as the adjustment value in the second calibration data memory M2 in S28, and the process ends.

By performing the second calibration data input process in this manner, the ink sensor 19 is set to output a uniform analog signal when receiving reflected light from ink cartridge 2 that is full of ink, regardless of the irregularity in sensitivity of the ink sensor 19.

Because the ink sensor 19 is adjusted in the second calibration data input process using the yellow ink cartridge 2*d* filled with brightest ink, the adjusted ink sensor 19 can reliably detect the existence of ink for the ink cartridges 2*a*–2*c* also, which contain less bright ink, as shown in FIG. 19. Also, because the adjustment value obtained through the second calibration input process is used not only for the yellow ink cartridge 2 but also any other ink cartridges 2. Therefore, even when a plurality of ink cartridges are used in a signal printer, a reliable detection can be performed by utilizing a single adjustment value without executing any additional process. This simplifies the second calibration data input process and reduces the time duration required to execute the same.

As described above, according to the process of FIG. 13, the position of the yellow ink cartridge 2*d* is detected by reading the amount of light reflected from each ink cartridge 2 after executing the calibration process. Therefore, even when the position of the yellow ink cartridge 2*d* is unknown, the second calibration data input process can be executed. Also, even when ink other than yellow ink is the brightest when, for example, the yellow ink is not used, the position of the ink cartridge with the brightest ink can be detected, so that the second calibration data input process can be executed in a reliable manner.

However, if the position of the brightest-color ink cartridge is known from the beginning, the processes of S20 and S22 could be omitted, and an encoder could be used in S24 to position the brightest ink cartridge.

The second calibration data input process is not limited to the process shown in FIG. 13. For example, the PWM value can be initialized in S23 to generate a maximum amount of infrared light. Subsequently, the PWM value is continuously increased by one until a voltage of a digital signal exceeds the threshold voltage value t3, and the PWM value of this point is stored in the second calibration data memory M2.

Next, the calibration process executed in S21 of FIG. 13 will be described while referring to the flowchart shown in FIG. 14. The calibration process is for correcting the detecting position of the ink cartridge 2 to the actual detecting position P1 based on the calibration value α stored in the first calibration data memory M1 and reads the level of reflected light at the corrected detecting position P1. The calibration process is executed during the process of FIG. 15 and the process of FIG. 16 also.

Figure 14:
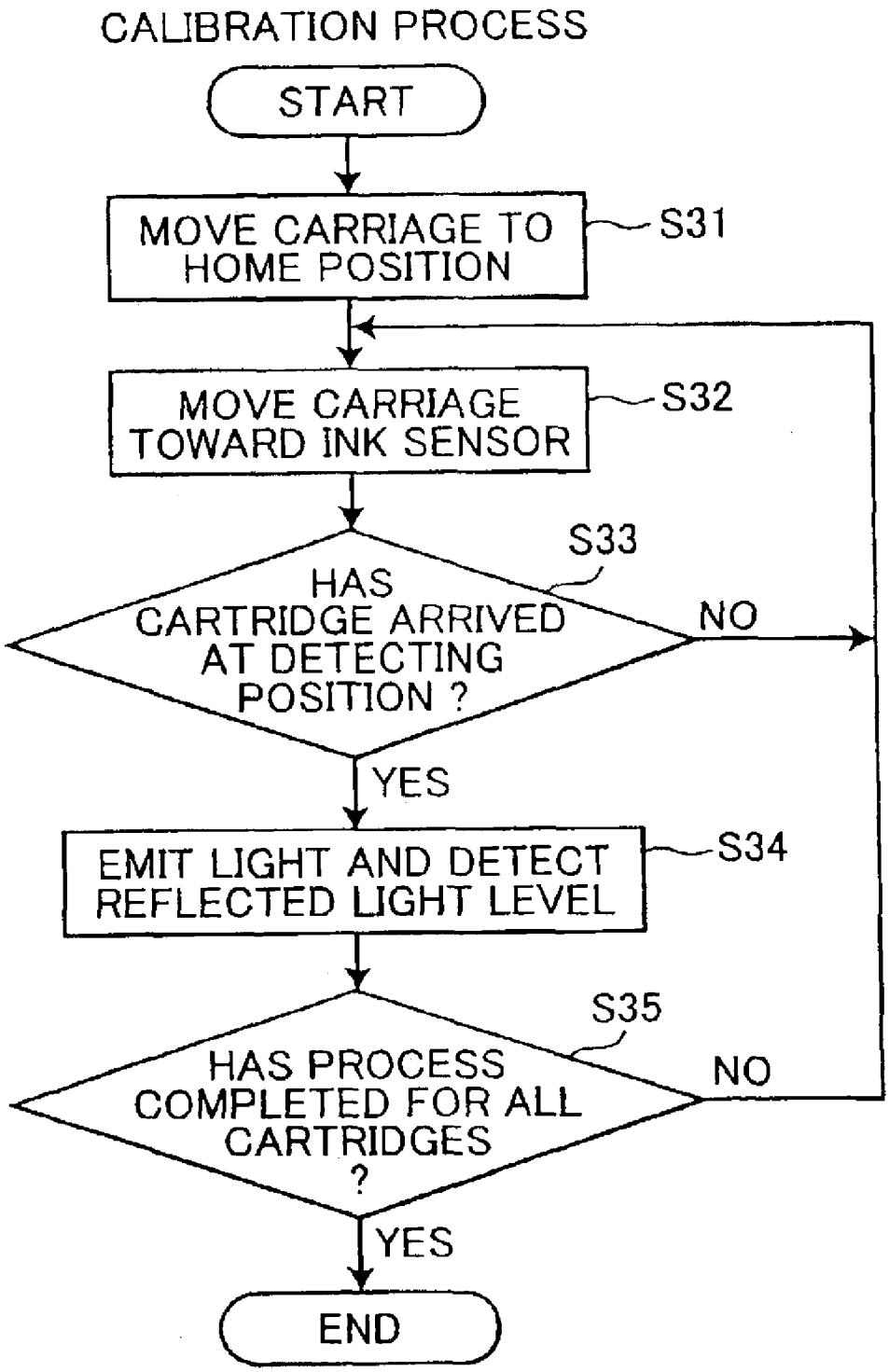
FIG. 14 is a flowchart representing a calibration process.

In the calibration process of FIG. 14, the carriage 5 is first moved to the home position in S31, and then in S32, the carriage 5 is moved from the home position toward the ink sensor 19. Next in S33, it is determined whether or not an ink cartridge 2 has reached the actual detecting position P1, which is the original detection position P1±calibration value α. If not (NO:S33), then the process returns to S32 to move the carriage 5 further toward the ink sensor 19. If so (YES:S33), a level of reflected light is detected in S34. At this time, infrared light is emitted from the infrared light-emitting element 19*a* based on the adjustment value stored in the second calibration data memory M2. Also, the reading is conducted at three locations at an interval of 1.5 times the interval of valleys in the prisms 52 as described above. Then, it is determined in S35 whether or not the level of reflected light has been detected for all the four ink cartridges 2. If not, (NO:S35), then the process returns to S32 to repeat the same processes until the level of light reflected from each ink cartridge 2 has been detected. On the other hand, if the level of reflected light has been detected for all the four ink cartridges 2 (YES:S35), then the calibration process ends.

Because the level of reflected light is detected in the calibration process at the prescribed actual detection position P1 (one point) for each ink cartridge 2, the level of reflected light is indicated by pinpoint data detected at a single point. Hence, the present invention can perform efficient data by reducing the amount of data to be processed. Further, even if the existence of ink is detected while the carriage 5 is moving at a high speed, the ink cartridge 2 is conveyed precisely to the actual detecting position P1 based on the calibration value α stored in the first calibration data memory M1. Accordingly, the level of reflected light can be detected accurately (even with point data).

Next, a process executed during printing in the color inkjet printer 1 will be described while referring to FIG. 15. During the process of FIG. 15, the ink detection process for detecting the existence of the ink 71 in the ink cartridge 2 is executed at proper timings, namely, during the paper-feed interval at the beginning of printing operations, during the paper-feed interval between printing each page thereafter, and during line feed interval.

Figure 21:
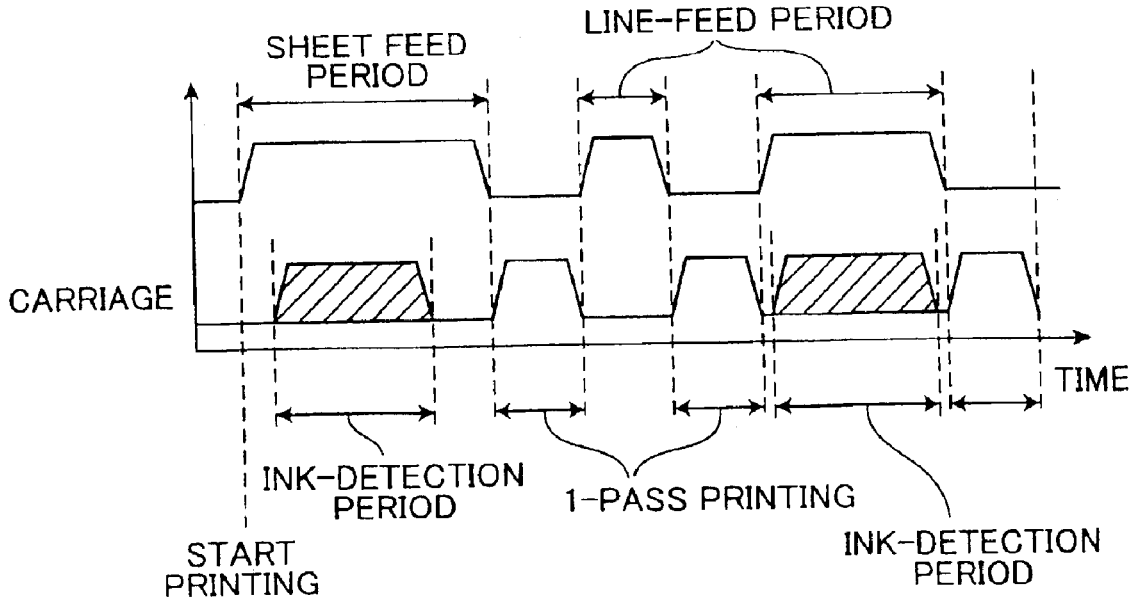
FIG. 21 is a timing chart showing the timing of the ink detection process.

The paper-feed interval is for feeding a recording sheet P from the paper feed tray 201 to a position between the print head 3 and the platen roller 7. Although the ink detection process takes certain time duration, as shown in FIG. 21, the paper-feed interval is longer than the time duration required to execute the ink detection process. Accordingly, using the paper-feed interval wherein the carriage 5 is conventionally stopped, it is possible to execute the ink detection process without putting the printing operation on standby, thereby improving processing speed of the inkjet printer 1 while performing an accurate ink detection process. That is, in the present embodiment, the paper feed and the ink detection are executed simultaneously.

The line feed interval is where the recording sheet P is fed by one-pass-worth of distance or more after one-pass printing. More specifically, line feed is performed each time one-pass printing is performed so as to feed the recording sheet P by a distance of one-pass-width or more as shown in FIG. 21. The amount of line feed varies depending on print data. As described above, during the printing process, the one-pass printing and the line feed are repeatedly performed in alternation. Actual printing is not performed during the line feed, but only the recording sheet P is fed by a necessary amount. Depending on the printing details, the line feed is conducted not only for a single pass, but also for a plurality of passes at one time. It is possible to conduct an ink detection process in the latter period. Accordingly, the ink detection process can be performed if the time required to perform a line feed is longer than the time required to perform the ink detection process without halting the printing operation. This prevents a loss in processing speed of the image-forming device.

Figure 15:
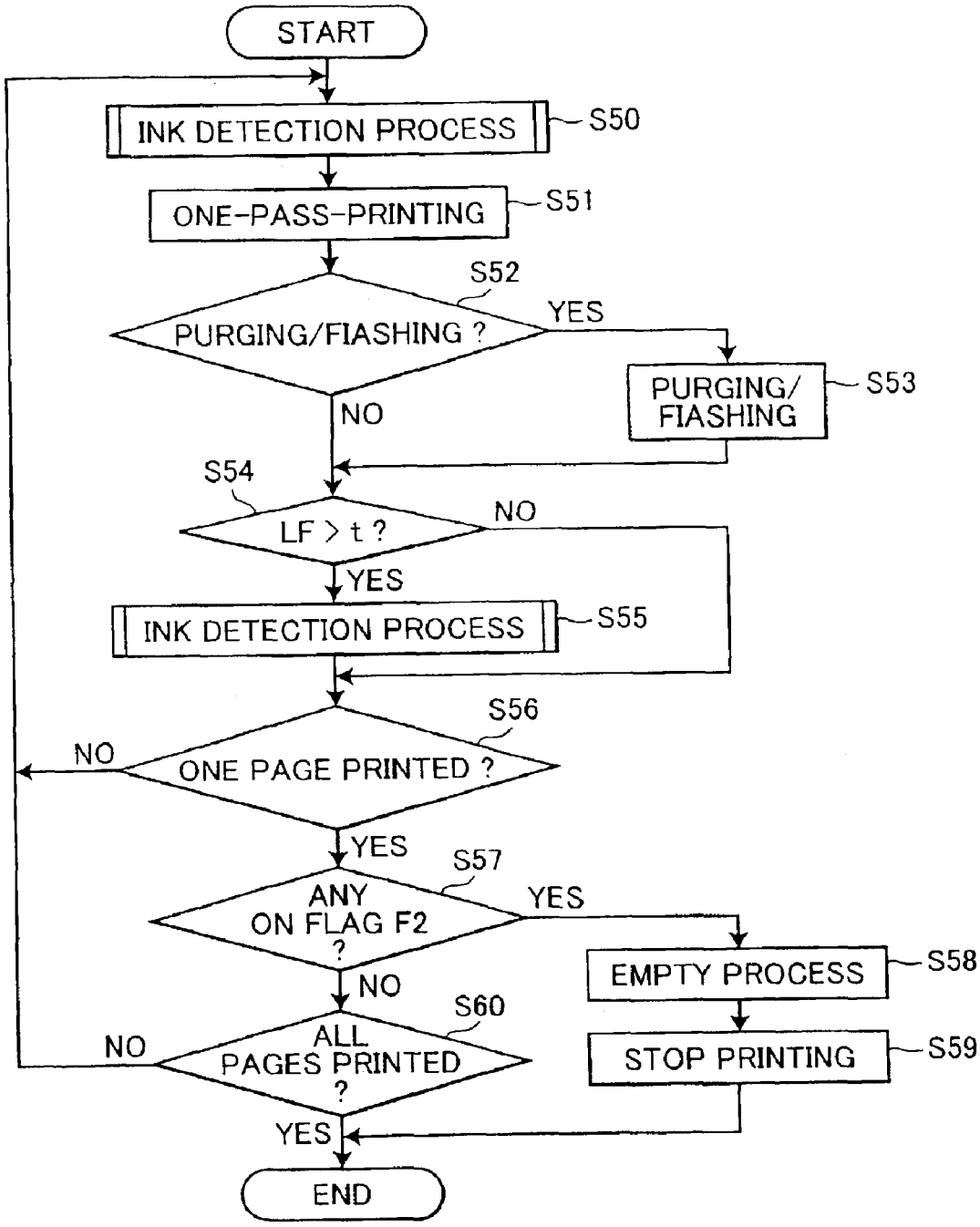
FIG. 15 is a flowchart representing a process executed in the color inkjet printer of FIG. 1.
Figure 16:
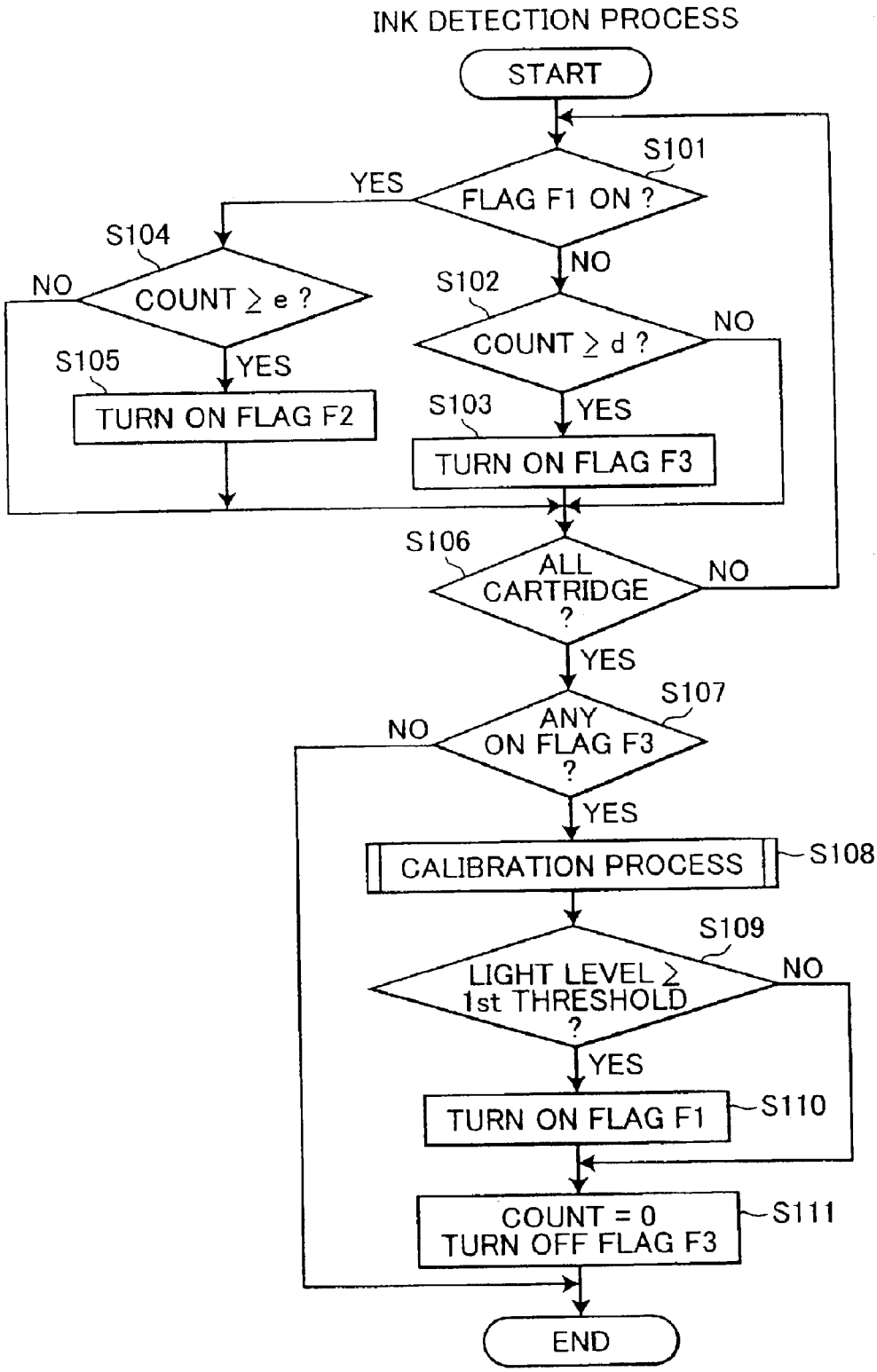
FIG. 16 is a flowchart showing an ink detection process executed during the process of FIG. 14 for detecting the existence of ink.

In FIG. 15, when the process starts, the ink detection process is executed in S50 during the paper-feed interval. FIG. 16 shows the flowchart representing the ink detection process. As shown in FIG. 16, when the ink detection process is started, it is determined in S101 whether not a near-empty flag F1 corresponding to subject one of the ink cartridges 2 is ON. If not (S101:NO), then in S102 it is determined whether or not the count value of corresponding counter C is equal to or greater than the prescribed count d, which is 100 for example. If so (S102:YES), the corresponding count-d flag F3 is turned ON, and the process proceeds to S106. On the other hand, if a negative determination is made in S102 (S102:NO), then the process directly proceeds to S106.

If it is determined in S102 that the near-empty flag F1 is ON (S101:YES), this means that the near empty has been detected, and then in S104 it is determined whether or not the count value of the corresponding counter C is equal to or greater than the empty threshold count e. If so (S104:YES), this indicates the subject ink cartridge 2 is close to empty but contains sufficient ink for completing one page printing. Then, the corresponding empty flag F2 is turned ON in S105, and the process proceeds to S106. On the other hand, if a negative determination is made in S104 (S104:NO), this indicates that sufficient ink still remains, and then the process directly proceeds to S106.

In S106, it is determined whether or not the above processes in S101 through S105 has been executed with respect to all the four ink cartridges 2. If not (S106:NO), the process returns to S101 to repeat the above processes for next one of the ink cartridges 2.

If the processes from S101 to S105 have been completed for all the four cartridges 2 (S106:YES), then the process proceeds to S107. In S107, it is determined whether or not any count-d flag F3 is ON. If all the four count-d flags F3 are OFF (S107:NO), the ink detection process ends. On the other hand, if even one of the count-d flags F3 is determined to be ON in S107 (S107:YES), then in S108 the above described calibration process is executed.

After the calibration process is executed in S108, it is determined in S109 whether or not there is any level of reflected light, reflected from the ink cartridge 2 whose count-d flag F3 is determined ON in S107, equal to or greater than the first threshold value t1. In other words, the process in S108 is executed with respect to only the ink cartridge(s) 2 whose count-d flag F3 is ON, and the level of reflected light is read for the subject ink cartridge(s) 2 only. If the level of all the subject reflected light is lower than the first threshold value t1 (S109:NO), the process proceeds to S111 to reset the count value and turn OFF the count-d flag F3 of the subject ink cartridge(s) 2, and the process ends. On the other hand, if any of the level of reflected light that is equal to or greater than the first threshold value t1 (S109:YES), this indicates that the ink level of the corresponding ink cartridge 2 is near empty. Then in S110, the near-empty flag(s) F1 corresponding to the ink cartridge(s) 2 that is near empty is turned ON, and process proceeds to S111.

After completing the ink detection process of FIG. 16, then the process returns to S51 of FIG. 15. In S51, one-pass printing is performed for printing one-pass-worth of image. Next in S52, it is determined whether the purging operation or the flushing operation is to be performed or not. If not (S52:NO), the process proceeds to S54. If so (S52:NO), then in S53 the purging or flushing operation is performed, and the process proceeds to S54.

In S54, it is determined whether or not the line-feed interval is greater than a predetermined time duration t that is required to execute the ink detection process. If so (S54:YES), this means the ink detection process can be completed during the next line feed, so that the ink detection process described above is executed in S55, and the process proceeds to S56. On the other hand, if not (S54:NO), then the process directly proceeds to S56 without executing the ink detection process.

In S56, it is determined whether or not printing is completed for one page. If not (S56:NO), then the process returns to S50 to repeat the same process until the printing is completed for the current page. If so (S56:YES), then it is determined in S57 whether or not any empty flag F2 is ON. If not (S57:NO) it is determined in S60 whether the printing has been completed for all pages. If so (S60:YES), the process ends. If not (S60:NO) the process returns to S50. If an affirmative determination is made in S57 (S57:YES), an ink-empty process is executed in S58 and a message indicating that the ink cartridge 2 is empty is displayed on the liquid crystal display 107*b* to urge the user to replace the ink cartridge 2. Then in S59, the current process is stopped, and any print data, such as facsimile data, which has not been printed because of the ink-empty is stored in a memory.

As described above, the ink-empty process of S58 is not immediately executed even if ink empty of the ink cartridge 2 is detected in S104. Instead, the ink-empty process is executed only after printing for a current page is completed without stopping printing operation in the middle of the page. This is because the ink cartridge 2 still contains sufficient ink for one-page printing after the ink empty is detected. Accordingly, the problems that the ink runs out in the middle of page can be prevented, and also effective use of ink is possible.

In the above described process, the ink detection operation is executed every time and right before the purging or flushing operation is performed.

Because the calibration process in the ink detection process is executed every time the count value reaches the value d, the present invention can determine an interval for executing the calibration process for checking the amount of reflected light as well as counting the amount of expended ink to determine when the ink cartridge 2 is empty.

It should be noted that the ink cartridges 2 may vary in the amount of ink 71 they contain, for example, when inserting a used product or one with manufacturing irregularities. Also, when considering variations in the amount of ink ejected from the print head 3 in different inkjet printers 1, the count value will not always be uniform. Therefore, if the ink ejection is simply counted from an initialized state until the ink cartridge 2 is empty, it is difficult to determine when the ink cartridge 2 is empty using a prescribed ejection count number. Determining when an ink cartridge 2 is empty based on the prescribed ejection count number tends to be unreliable. However, the amount of remaining ink in the ink cartridge 2 at the point that the ink cartridge 2 is determined to be near empty can be treated as approximately uniform. Hence, the number of ink ejections (count number) required to expend this amount of remaining ink can be thought of as uniform. Accordingly, a prescribed number near this number of ink ejections is set as the empty threshold value e. By setting the count value to 0 at the point the ink cartridge 2 is found to be near empty and incrementing this count value every ink ejection up to the empty threshold value e, it is possible to detect with accuracy when the ink cartridge 2 is empty.

Figure 17:
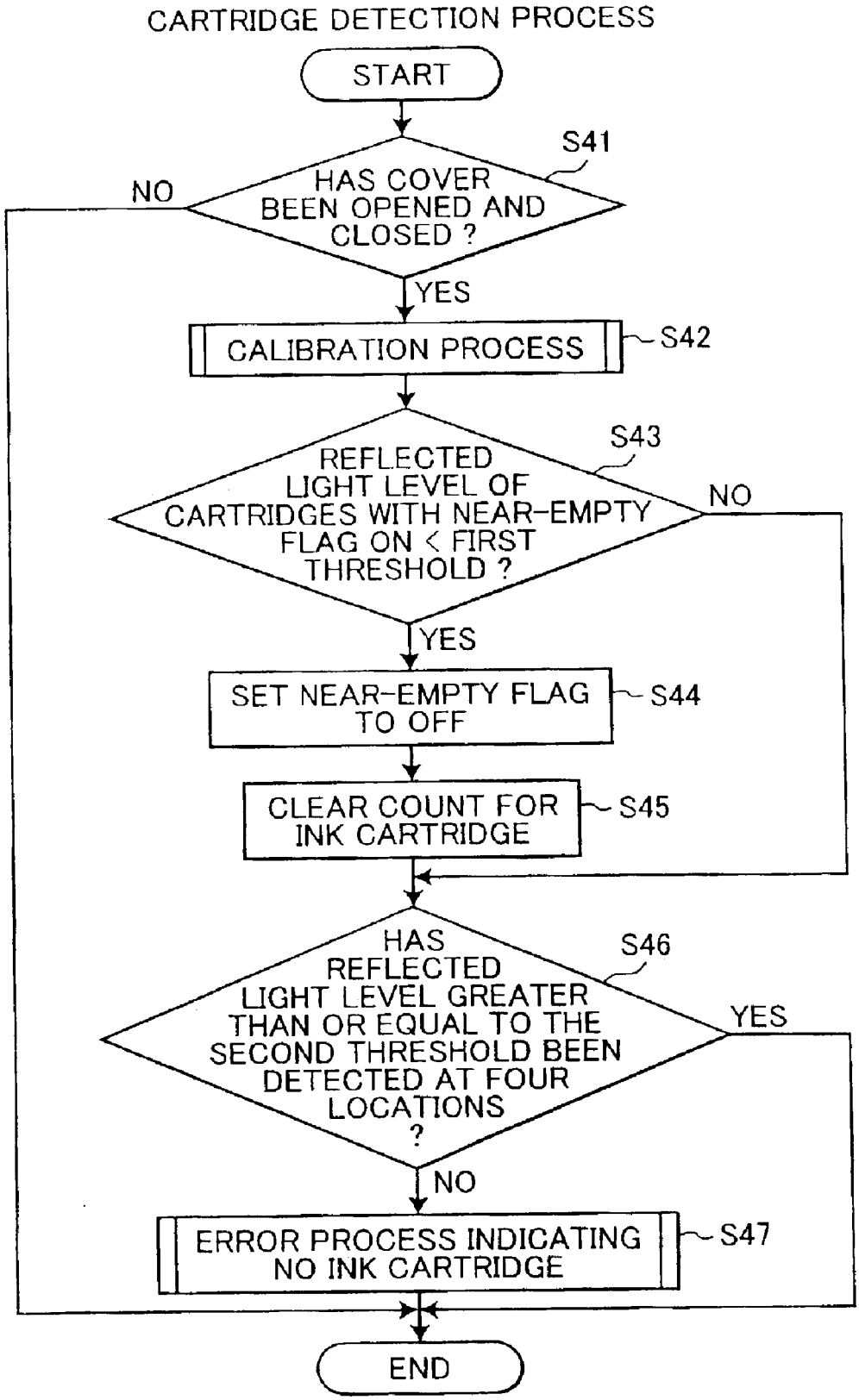
FIG. 17 is a flowchart showing an ink cartridge detection process.

Next, the ink cartridge detection process for detecting whether or not an ink cartridge 2 is mounted on the head unit 4 will be described while referring to the flowchart shown in FIG. 17. The ink cartridge detection process is executed each time an ink cartridge 2 is replaced. A sensor provided on a cover of the inkjet printer 1 detects when the cover is opened and closed. This action is perceived as an ink cartridge replacement operation.

When the ink cartridge detection process starts, first in S41, it is determined whether or not the cover has been opened and subsequently closed. If not (NO:S41), the process ends. On the other hand, if so (YES:41), the above-described calibration process of FIG. 14 is executed in S42 to detect the amount of reflected light from the ink cartridge 2 at the detecting position P1. Then, in S43, an ink cartridge (s) 2 whose near-empty flag F1 is ON is detected, and it is determined whether or not the level of light reflected from thus detected ink cartridge 2 is less than the first threshold value t1. If it is determined that the level of reflected light is less than the first threshold value t1 (YES:S43), this indicates that the subject near empty ink cartridge 2 has been replaced. Then, in S44, the corresponding near-empty flag F1 is turned OFF, and the count value of the corresponding counter C is cleared in S45. If a negative determination is made in S43 (NO:S43), then the process directly proceeds to S46. Next, in S46, it is determined whether or not a level of reflected light greater than or equal to the second threshold value t2 has been detected at all the four locations of the reading waveform, each corresponding to one of the ink cartridges 2. If a level of reflected light less than the second threshold value t2 is detected in S46 (NO:S46), this means that there is an ink cartridge 2 not mounted on the head unit 4, so that a no-ink-cartridge error process is conducted in S47 to notify the user that an ink cartridge 2 is not mounted in the head unit 4, and the ink cartridge detection process ends.

If it is determined in S46 that a level of reflected light exceeding the second threshold value t2 is detected at all of the four locations (YES:S46), indicating that all ink cartridges 2 are mounted in the printer, the ink cartridge detection process ends.

As described above, according to the first embodiment of the present invention, because the level of light emitted from the infrared light-emitting element 19*a* has been adjusted using the ink cartridge containing yellow ink, the ink sensor 19 can detect remaining ink with great accuracy, even when the ink sensor 19 has irregularities in sensitivity.

Since the amount of light reflected by the yellow ink cartridge is the largest, the present invention can still reliably detect remaining ink in the other ink cartridges when the amount of emitted light is adjusted to achieve proper ink detection in the yellow ink cartridge. Therefore, when the printer uses multiple colors of ink, it is possible to apply a single adjustment value to all ink cartridges, thereby simplifying the process and reducing the processing time.

Moreover, since the level of light emitted from the infrared light-emitting element 19*a* is adjusted using the yellow ink cartridge 2*d* containing ink only in the sub ink reservoir 45, a precise adjustment can be achieved under more severe conditions than when adjusting the level of emitted light using an ink cartridge 2*d* containing ink in both the main ink reservoir 44 and the sub ink reservoir 45. In other words, the amount of reflected light is greater from an ink cartridge 2*d* containing ink only in the sub ink reservoir 45 than one containing ink in both the main ink reservoir 44 and the sub ink reservoir 45. Consequently, a more accurate adjustment can be made under conditions closer to those in a near-empty state.

As described above, in the calibration process, light is emitted from the infrared light-emitting element 19*a* based on the adjustment value stored in the second calibration data memory M2. The detecting position for detecting the level of reflected light is calibrated based on the calibration value $\alpha$ stored in the first calibration data memory M1. Accordingly, it is possible to execute the ink cartridge detection process and the ink detection process with high accuracy, even if the relative position of the ink sensor 19 and the irradiation surface of the ink cartridge 2 deviates from the original position. By correcting the detecting position with the calibration value $\alpha$, parameters and comparison data can be more easily set than when electrically calibrating the amount of detecting light itself.

In the inkjet printer 1 of the embodiment described above, the ink sensor 19 detects the amount of reflected light by emitting light in a direction non-perpendicular to the irradiation surface of the ink cartridge 2. The amount of detected light is compared to the first threshold value t1 to determine whether or not ink exists in the ink cartridge 2 and to the second threshold value t2 to determine whether or not an ink cartridge 2 is mounted in the carriage 5, making it possible to determine when an ink cartridge 2 is out of ink and when an ink cartridge 2 is missing. Accordingly, the present invention can accurately detect the existence of the ink 71 and the existence of an ink cartridge 2 mounted on the carriage 5 based on the light reflected from the ink cartridge 2.

In addition, the present invention calculates the difference between the actual detecting position P1 and the theoretical detecting position P2 and calibrates the position of the carriage 5 for detecting the existence of ink 71 or a mounted ink cartridge 2 based on this calculated error. Hence, when the actual detecting position P1 of the ink cartridge 2 deviates from the theoretical detecting position P2 due to an error generated when mounting the ink sensor 19, it is possible to correct this deviation in order to detect the level of reflected light with accuracy.

In the above-described embodiment, the calibration process in the ink detection process is executed every time the count value reaches the count value d. However, the ink detection process could be executed only after the amount of expended ink has reached a prescribed amount.

In the above-described first embodiment, the ink detection process is executed during the paper-feed interval directly after the printing process beings and between printing each page thereafter. However, the ink detection process could be executed in a paper-discharging interval also by executing the ink detection process between S56 and S57 of FIG. 14. The paper-discharging interval is defined as the period after the printing has completed in which the recording sheet P is discharged from the printer 1. If the ink detection process is conducted during the paper-discharging period, then the existence of ink can be detected prior to feeding the next sheet of recording sheet P. Hence, it is possible to avoid the ink empty process being executed immediately after a recording sheet P has been set in the printer 1 between the print head 3 and the platen roller 7, thereby eliminating the need for the user to discharge the recording sheet P from the inkjet printer 1. In this case, the ink detection process in S50 of FIG. 14 could be omitted.

Also, it is conceivable to execute the ink detection process every time the maintenance operation, such as the purging operation and the flushing operation, is executed. In this case, after the purging or flushing operation is performed in S53 of FIG. 15, the process could directly proceed to the process of S55 without the process of S54.

The present invention is not limited to sloping the sloped portion 51*a* as described in the first embodiment, such that the sloped portion 51*a* is sloped approximately 20 degrees in relation to the reflecting member 53. The reflecting member 53 can be sloped instead of the sloped portion 51*a*, while obtaining the same effects described in the first embodiment.

Also, the reflecting member 53 could be configured with a reflecting plate to reflect light that reaches thereto. Further, the reflecting member 53 could be provided separately in the sub ink reservoir 45, but the partition 42 could also be configured as the reflecting member 53.

Next, a second embodiment of the present invention will be described with reference to FIGS. 22(*a*) and 22(*b*). While the ink cartridge 2 of the first embodiment is configured with the reflecting member 53 to change the optical path of the infrared light, an ink cartridge 130 of the second embodiment includes an infrared light-absorbing member 131 for absorbing infrared light. Parts and components similar to those in the first embodiment are designated by the same reference numerals to avoid duplicating description.

Figure 22A:
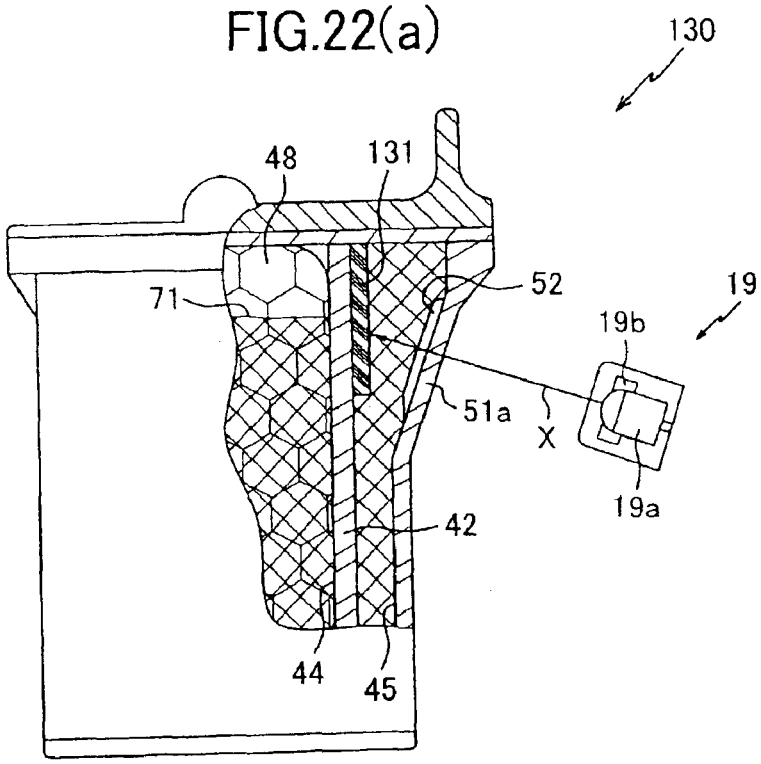
FIG. 22(*a*) is a side view showing an ink cartridge and an ink sensor according to a second embodiment of the present invention and optical paths when the ink cartridge contains sufficient ink.
Figure 22B:
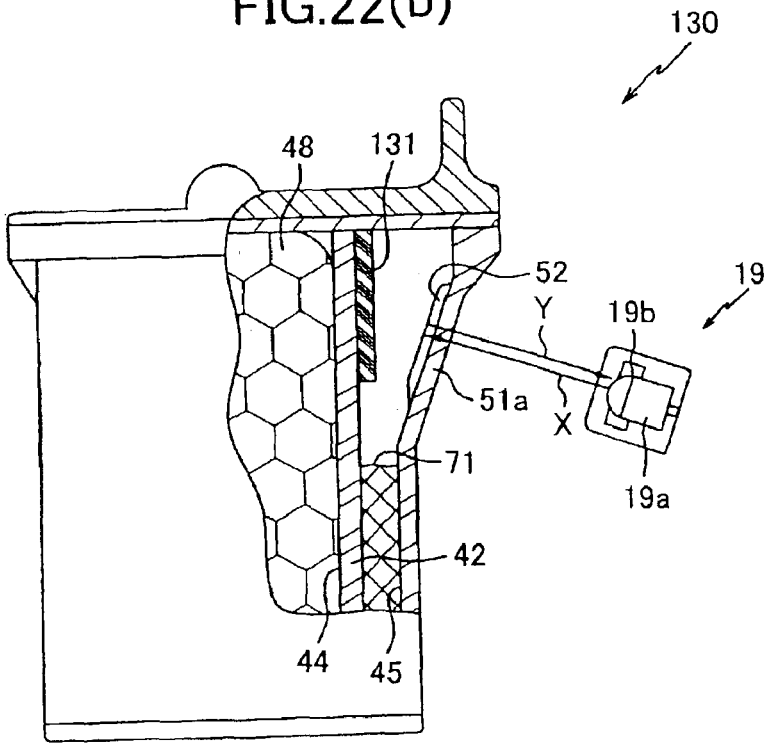

FIGS. 22(*a*) and 22(*b*) are side views showing the ink cartridge 130 and the ink sensor 19 with a partial cross-sectional view of the ink cartridge 130. The mounting members and the like for the head unit 4 and ink sensor 19 are omitted from these drawings for illustration purposes.

Similar to the ink cartridge 2 of the first embodiment, the ink cartridge 130 of the present embodiment includes the prisms 52 formed on an inner surface of a sloped portion 51*a* on which infrared light is irradiated. The inside of the ink cartridge 130 is partitioned by the partition 42 into a main ink reservoir 44 and a sub ink reservoir 45. The infrared light-absorbing member 131 is provided in the sub ink reservoir 45 in opposition to and separated a prescribed distance from the prisms 52. The infrared light-absorbing member 131 absorbs infrared light emitted from the ink sensor 19 that passes into the ink cartridge 130.

Next, the method of detecting the existence of the ink 71 in the ink cartridge 130 will be described. As in the first embodiment, the ink sensor 19 emits infrared light from the infrared light-emitting element 19*a* toward the sloped portion 51*a*. The infrared light-receiving element 19*b* receives reflected light and determines whether the ink cartridge 130 contains ink based on the amount of reflected light.

More specifically, when the sub ink reservoir 45 is filled with ink 71 as shown in FIG. 22(*a*), infrared light emitted from the infrared light-emitting element 19*a* (optical path X) penetrates the ink 71 and reaches the infrared light-absorbing member 131, and the light is absorbed thereby. Accordingly, the amount of reflected light received by the infrared light-receiving element 19*b* is smaller than a fixed value.

The absorbing properties of the infrared light-absorbing member 131 may degrade over time, causing the infrared light reaching the infrared light-absorbing member 131 to be reflected. However, because the sloped portion 51*a* is sloped at approximately 20 degrees in relation to the infrared light-absorbing member 131 in the similar manner as in the first embodiment, the infrared light reaching the infrared light-absorbing member 131 is reflected in a direction different from the optical path X. Hence, it is possible to suppress the amount of unnecessary reflected light detected by the infrared light-receiving element 19*b*.

On the other hand, when the sub ink reservoir 45 is out of ink 71 as shown in FIG. 22(*b*), the infrared light emitted from the infrared light-emitting element 19*a* (optical path X) is reflected by the interface between the prisms 52 and the air (optical path Y). As a result, the amount of reflected light received by the infrared light-receiving element 19*b* is much larger than the fixed value.

According to the second embodiment described above, the infrared light-absorbing member 131 absorbs infrared light. Therefore, the amount of light reflected from the ink cartridge 130 changes greatly according to whether the ink cartridge 130 contains ink or not. By detecting this difference in amount of reflected light using the ink sensor 19, it is possible to detect with accuracy whether or not ink exists in the ink cartridge 130.

By providing the sloped portion 51*a* (prisms 52) and infrared light-absorbing member 131 at the top of the sub ink reservoir 45, the present invention can detect when the ink cartridge 130 is running out of ink in plenty of time before all of the ink 71 is expended.

In general, any of infrared absorbing members well known in the art that is available can be used as the infrared light-absorbing member 131. The infrared absorbing member can be formed, for example, of V (vanadium), Fe (iron), Cu (copper), Co (cobalt), Ni (nickel), or any combination thereof on a base material of glass. Further, the base material is not limited to a solid or liquid. For example, the base material can include an infrared absorbing material such as a metal chelate compound of acetylacetone, an anthraquinone compound, a naphthoquinone compound, an aromatic diammine metal complex, an aromatic dithiol metal complex, or an aliphatic dithiol metal complex. It is also possible to use members having filtering properties for absorbing specific ranges of optical wavelengths, particularly a member having a 90% or greater absorbing ratio of infrared light having a wavelength of 700 nm to 900 nm.

The electrical construction of the color inkjet printer 1 according to the second embodiment is the same as that according to the first embodiment shown in FIG. 10. Further, the processes conducted by the inkjet printer 1 in the second embodiment are the same as those conducted by the inkjet printer 1 in the first embodiment described in FIGS. 12 to 17. Therefore, a description of these constructions and processes has been omitted.

Figure 23A:
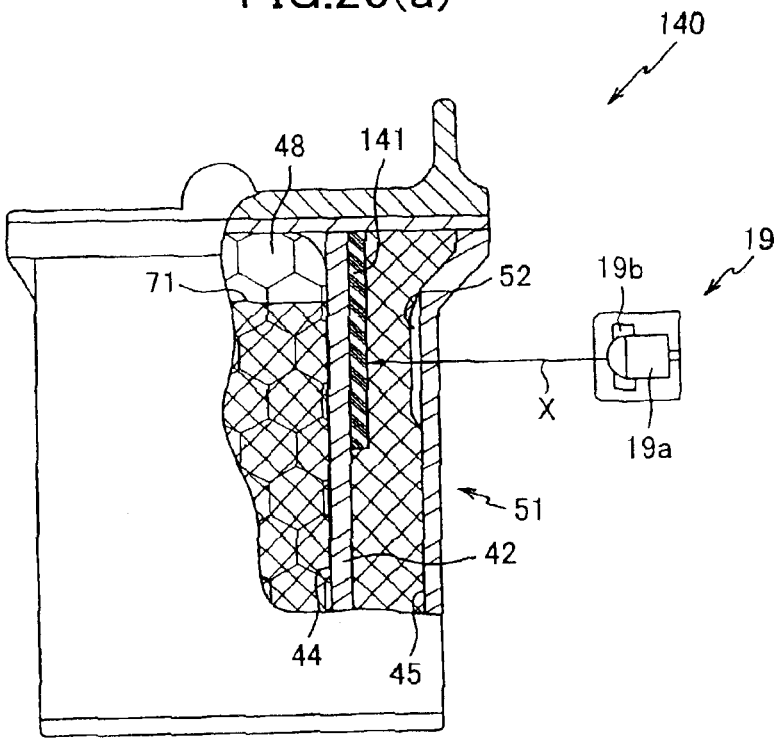
FIG. 23(*a*) is a side view showing an ink cartridge and an ink sensor according to a modification of the second embodiment and the optical paths when the ink cartridge contains sufficient ink.
Figure 23B:
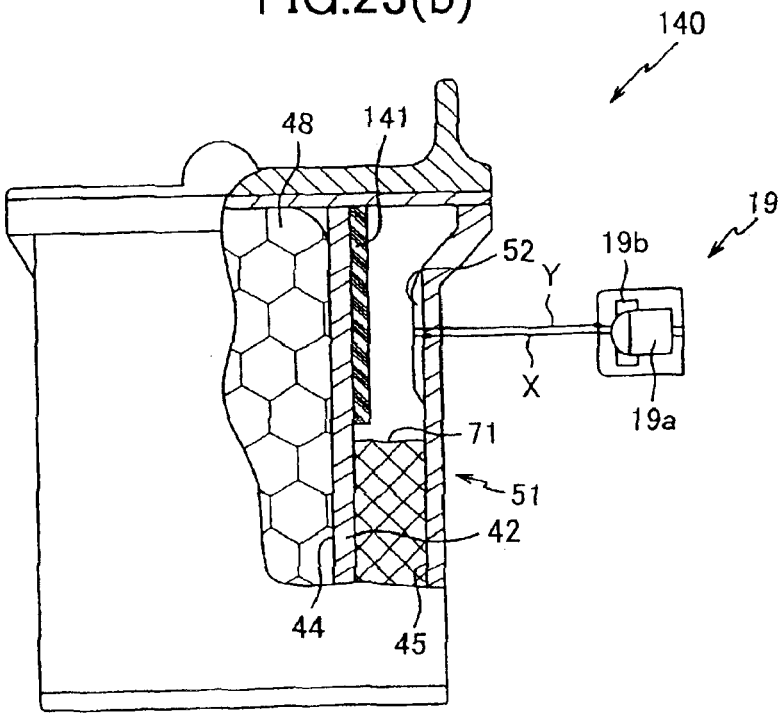

In the second embodiment, the sloped portion 51*a* is configured to be sloped in relation to the infrared light-absorbing member 131. However, as shown in FIGS. 23(*a*) and 23(*b*), it is also possible to arrange a light absorbing member 141 and the side wall 51 (prisms 52) in parallel. By providing the light-absorbing member 141 along the optical path X of the infrared light emitted from the infrared light-emitting element 19*a*, it is possible to accurately detect the existence of ink.

also, inn the above-described second embodiment, the partition 42 or foam 48 could be configured of an infrared light-absorbing member. The infrared light-absorbing member 131 and light-absorbing member 141 could also be accommodated in the reflecting member 53 of the first embodiment formed with an air pocket. In this case, the infrared light-absorbing member 131 or light absorbing member 141 can be provided inside the ink cartridge and partitioned from the ink 71, enabling the use of a light-absorbing material that may have properties degraded by ink or that adversely affect the ink. Further, since the infrared light-absorbing member can be hermetically sealed in the pocket formed in the reflecting member 53, this member can be formed of a liquid.

While the invention has been described in detail with reference to specific embodiments thereof, it would be apparent to those skilled in the art that many modifications and variations may be made therein without departing from the spirit of the invention, the scope of which is defined by the attached claims.

For example, while the embodiments described above use an inkjet printer as the image-forming device, the present invention is not limited to this apparatus, but can be applied to an inkjet type photocopier, facsimile device, and the like. In addition, four ink cartridges 2 are mounted in the inkjet printer 1, but any number of ink cartridges 2 can be provided.

In the calibration data input process described above, a calibration value α for correcting deviation between the theoretical detecting position P2 and actual detecting position P1 is calculated based on the single ink cartridge 2*a* used as the standard, and the position of the ink cartridge 2 is corrected in the calibration process (S15) based on the single calculated calibration value α. However, it is also possible to calculate correction values for each ink cartridge 2 or for the ink cartridge 2 on each end and to correct the detection position of the ink cartridges 2 based on these calculated calibration values. With this method, it is possible to detect the precise detection position with even greater accuracy.

In the embodiments described above, a counter C is provided for each ink cartridge 2. Each counter performs a count for an ink detection interval in the ink detection process. However, when one of the near-empty flags F1 is turned ON, the count value for the counters C corresponding to the near-empty flags F1 that has been turned ON is cleared and begins counting the number of ink ejections up to an empty threshold count e. Instead, however, it is possible to provide two counters for each ink cartridge 2. One counter would count the number of total ink ejections from the beginning up to an ink empty value in the ink detection process, while the other would count the detection interval according to the number of ink ejections. These counters can also be configured such that the first counter counts the total number of ink ejections from the beginning until the ink cartridge 2 is empty, while the second counter counts the ink detection intervals according to the number of ink ejections.

While the degree of slope in the sloped portion 51*a* is set to approximately 20 degrees in the present embodiment, the present invention is not limited to this angle. The slope of the sloped portion 51*a* can be set within a range of approximately 15 to 25 degrees. That is, by setting the slope of the sloped portion 51*a* to approximately 15 degrees or greater, it is possible to cut down on the amount of light reflected from the reflecting member 53 back to the infrared light-receiving element 19*b*. Further, an angle of approximately 25 degrees or less can discourage ink from remaining on the sloped portion 51*a*.

Although the slope of the ink sensor 19 in relation to the sloped portion 51*a* is set at approximately 10 degrees in the present embodiment, this angle is determined by many factors including the size of the ink cartridge 2, the space between neighboring ink cartridges 2, and the space between the ink cartridge 2 and the ink sensor 19. Therefore, this angle is not limited to 10 degrees, provided the ink sensor 19 is set at an angle to the sloped portion 51*a*.

What is claimed is:

1. A cartridge for an image forming device that includes a carriage that mounts the cartridge thereon and moves along with the cartridge, a sensor that detects an amount of reflected light reflected from the cartridge, the sensor including a light emitting unit that irradiates a light onto the cartridge and a light receiving unit that receives the reflected light, a detection unit that detects an amount of an ink contained in the cartridge based on the amount of the reflected light detected by the sensor, and a reading unit that controls the carriage to move to a predetermined position where the light irradiated from the light emitting unit is irradiated onto the cartridge and reads levels of reflected light from a waveform for the amount of reflected light at a reading interval, based on which the detection unit detects the amount of the ink contained in the cartridge, the cartridge comprising:

a casing having a light receiving portion that receives the light from the light emitting unit, the light receiving portion being provided with prisms in a shape that repeatedly alternates in peaks and valleys, wherein adjacent two of the valleys are separated by a predetermined valley interval, wherein the predetermined valley interval is a non-integral fraction of the reading interval.

2. The cartridge according to claim 1, wherein the reading interval is larger than the predetermined valley interval and less than two times the predetermined valley interval.

3. The cartridge according to claim 2, wherein the reading interval is within a range of 1.3 to 1.7 times the predetermined valley interval.

4. The cartridge according to claim 3, wherein the reading interval is 1.5 times the predetermined valley interval.

5. The cartridge according to claim 1, wherein the prisms cover nearly the entire width of the light receiving portion.

6. The cartridge according to claim 5, wherein the number of reflecting surfaces of the prisms is between eight and sixteen.

7. The cartridge according to claim 1, wherein reflecting surfaces of the prisms intersect with one another at 90 degrees.

8. The cartridge according to claim 1, wherein the prisms include a center valley located in the center of the light receiving portion.

9. An ink cartridge, comprising:

a casing having a portion formed of a material capable of receiving light from a light emitting device provided in an image forming apparatus;

wherein:

the portion includes repeating prism-shaped structures including peaks and valleys positioned between the peaks; and adjacent valleys are separated by a predetermined valley interval, the predetermined valley interval being a non-integral fraction of a reading interval at which the image forming apparatus reads an amount of reflected light, the reflected light being light emitted by the light emitting device and reflected by the portion of the cartridge.

10. The cartridge according to claim 9, wherein the reading interval is between the predetermined valley interval and two times the predetermined valley interval.

11. The cartridge according to claim 10, wherein the reading interval is within a range of 1.3 to 1.7 times the predetermined valley interval.

12. The cartridge according to claim 11, wherein the reading interval is 1.5 times the predetermined valley interval.

13. The cartridge according to claim 9, wherein the prism-shaped structures substantially cover an entire width of the portion.

14. The cartridge according to claim 13, wherein the prism-shaped structures include between eight and sixteen reflecting surfaces.

15. The cartridge according to claim 14, wherein reflecting surfaces of the prism-shaped structures intersect with one another at 90 degrees.

16. The cartridge according to claim 9, wherein the prism-shaped structures include a center valley located in a center of the portion.

* * * * *